US012312776B2

(12) United States Patent
Jura et al.

(10) Patent No.: US 12,312,776 B2
(45) Date of Patent: May 27, 2025

(54) ANTI-TIPPING FEATURES FOR A RETAINING MECHANISM

(71) Applicant: Caterpillar Inc., Peoria, IL (US)

(72) Inventors: Jason Grant Jura, Tremont, IL (US); Eric T. Sinn, Tremont, IL (US); Douglas C. Serrurier, Morton, IL (US); Corey Michael Wells, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/229,258

(22) Filed: Aug. 2, 2023

(65) Prior Publication Data

US 2023/0383503 A1 Nov. 30, 2023

Related U.S. Application Data

(62) Division of application No. 17/175,044, filed on Feb. 12, 2021, now Pat. No. 11,761,177.

(51) Int. Cl.
*E02F 9/28* (2006.01)

(52) U.S. Cl.
CPC ..... *E02F 9/2833* (2013.01)

(58) Field of Classification Search
CPC ..... E02F 9/2816; E02F 9/2833
See application file for complete search history.

(56) References Cited

U.S. PATENT DOCUMENTS

| | | | | |
|---|---|---|---|---|
| 7,681,341 | B2 | 3/2010 | Ruvang | |
| 7,762,015 | B2 | 7/2010 | Smith et al. | |
| 8,122,622 | B2 * | 2/2012 | Smith | E02F 9/2833 37/455 |
| 8,122,623 | B1 | 2/2012 | Hughes | |
| 8,925,221 | B2 | 1/2015 | Jeske | |
| 9,027,268 | B2 | 5/2015 | Campomanes | |
| 9,074,350 | B2 | 7/2015 | LaHood | |
| 9,074,351 | B2 | 7/2015 | Ballinger | |
| 9,121,160 | B2 * | 9/2015 | Hughes | E02F 9/2825 |
| 9,139,984 | B2 | 9/2015 | Chenoweth | |
| 9,228,325 | B2 | 1/2016 | Campomanes | |
| 9,309,651 | B2 | 4/2016 | Jeske | |
| 9,315,971 | B2 | 4/2016 | LaHood | |
| 9,328,484 | B2 | 5/2016 | Campomanes | |
| 9,388,553 | B2 | 7/2016 | Campomanes | |
| 9,534,356 | B2 | 1/2017 | LaHood | |
| 9,834,909 | B2 | 12/2017 | Guimaraes et al. | |

(Continued)

FOREIGN PATENT DOCUMENTS

| | | |
|---|---|---|
| AU | 2013200161 | 1/2013 |
| JP | 2007530838 | 11/2007 |

(Continued)

*Primary Examiner* — Gary S Hartmann

(57) ABSTRACT

A wear member includes a body having a forward closed portion, and a rear open portion defining a cavity. The wear member also includes an exterior surface, an interior surface defining the cavity, and a retaining mechanism receiving aperture. The retaining mechanism receiving aperture includes an interior portion defined by the interior surface, an exterior portion defined by the exterior surface, and a ring dividing the interior portion from the exterior portion and defining a thru-slot that is in communication with the interior portion and the exterior portion.

16 Claims, 14 Drawing Sheets

(56) References Cited

U.S. PATENT DOCUMENTS

| | | | | |
|---|---|---|---|---|
| 10,024,036 | B2 | 7/2018 | Johnston et al. | |
| 10,047,503 | B2 | 8/2018 | LaHood et al. | |
| 10,208,460 | B2 | 2/2019 | Almendros et al. | |
| 10,544,568 | B2 | 1/2020 | Lahood | |
| 11,180,991 | B2 | 11/2021 | Haro | |
| 11,225,779 | B2 | 1/2022 | Wells | |
| 11,365,530 | B2 | 6/2022 | Wells | |
| 11,761,177 | B2 * | 9/2023 | Jura | E02F 9/2833 37/455 |
| 2008/0148608 | A1 * | 6/2008 | Harder | E02F 9/2858 37/455 |
| 2014/0259806 | A1 | 9/2014 | Rimmey | |
| 2014/0259811 | A1 | 9/2014 | Ballinger | |
| 2014/0259813 | A1 | 9/2014 | Campomanes | |
| 2015/0368884 | A1 | 12/2015 | Cheyne et al. | |
| 2016/0160474 | A1 | 6/2016 | Kunz | |
| 2016/0160475 | A1 | 6/2016 | Kunz | |
| 2017/0030055 | A1 | 2/2017 | Lahood | |
| 2017/0328035 | A1 | 11/2017 | Bilal et al. | |
| 2017/0328037 | A1 | 11/2017 | Serrurier et al. | |
| 2017/0356166 | A1 | 12/2017 | Serrurier | |
| 2018/0080200 | A1 * | 3/2018 | Hughes | E02F 9/2841 |
| 2019/0153703 | A1 | 5/2019 | Hyde et al. | |
| 2020/0131742 | A1 | 4/2020 | Serrurier | |
| 2020/0340218 | A1 | 10/2020 | Wells et al. | |
| 2020/0378090 | A1 | 12/2020 | Jura | |
| 2021/0047809 | A1 | 2/2021 | Serrurier | |
| 2021/0095444 | A1 | 4/2021 | Serrurier | |
| 2022/0275609 | A1 | 9/2022 | Serrurier | |
| 2022/0403628 | A1 | 12/2022 | Wells | |

FOREIGN PATENT DOCUMENTS

| | | |
|---|---|---|
| RU | 2597654 | 9/2016 |
| RU | 2655869 | 5/2018 |
| WO | 2016089669 | 6/2016 |

* cited by examiner

ANTI-TIPPING FEATURES FOR A RETAINING MECHANISM

The present disclosure is a divisional of U.S. patent application Ser. No. 17/175,044, filed Feb. 12, 2021, the contents of which are hereby incorporated by reference in its entirety.

TECHNICAL FIELD

The present disclosure relates to retaining mechanisms employed on work implement assemblies such as bucket assemblies used by earth moving, mining, construction equipment and the like for attaching a tip to an adapter of the work implement assembly. More specifically, the present disclosure relates to a retaining mechanism that uses a retainer sleeve to hold a retainer of the retaining mechanism that in a locked or unlocked configuration.

BACKGROUND

Machines such as wheel loaders, excavators, and the like employ work implement assemblies including bucket assemblies, rakes, shears, etc. that have teeth or tips attached to them to help perform work on a material such as dirt, rock, sand, etc. For example, teeth or tips may be attached to a bucket assembly to help the bucket assembly to penetrate the ground, facilitating the scooping of the dirt into a bucket, etc. Adapters are often attached to the work edges (e.g., the base edge, the side edge, etc.) of the bucket or other work implement so that different styles of teeth or tips may be attached to the work implement. Also, the tips or teeth may be replaced easily when worn by providing a retaining mechanism that is used to selectively hold the tip onto the adapter or to allow the tip be removed from the adapter.

These retaining mechanisms may include a plastic retainer sleeve that holds the retainer in the tip. The retainer sleeve may also have features that hold the retainer in a locked or unlocked position to allow replacement of the tips. The retainer sleeve operates in various conditions and operating methods. In extreme operating conditions and methods, a more robust sleeve may be required. Also, the retainer may be tipped causing the retaining mechanism to jam or otherwise cease to work as desired.

Such a retaining mechanism is shown in U.S. Pat. No. 7,762,015 that includes a retainer with a tab that is rotated 180 degrees from a locking position to an unlocking position where a tip or the like may be removed from the adapter. This process may be reversed after a new or repaired tip is to be attached to the adapter once more. During the locking and unlocking of the retainer, the retainer may become undesirably cocked or tipped.

Similarly, U.S. Pat. No. 10,024,036 discloses wear members for wear assemblies include a lock configured to secure the wear member to a base, where the lock has two engagement positions, namely: (a) a first position that secures the lock to the wear member, and (b) a second position that secures the wear member to the base. The locks are further configured to be unlatched and removed from the wear member in two phases, a first retraction of the latching mechanism, followed by a rotation of the lock itself with removal from the wear member. However, this patent does not provide a retainer sleeve, nor does it teach how to prevent tipping of the lock when such a sleeve is used.

Accordingly, a retaining mechanism with one or more anti-tipping features is warranted for use with a retainer sleeve.

SUMMARY OF THE DISCLOSURE

A retainer according to an embodiment of the present disclosure may comprise a drive portion defining a drive portion outer diameter, and a lug receiving portion defining a lug receiving slot that extends partially through the lug receiving portion, forming a first sidewall, a second sidewall, and a catch surface connecting the first sidewall to the second sidewall. A skirt may at least partially define the first sidewall, the second sidewall, and the catch surface. The skirt may also define a skirt outer diameter that is greater than the drive portion outer diameter. Also, the drive portion may further include a hook tab that extends from the drive portion and that is spaced away from the skirt a minimum distance.

A wear member according to an embodiment of the present disclosure may comprise a body including a forward closed portion and a rear open portion defining a cavity, an exterior surface, an interior surface defining the cavity, and a retaining mechanism receiving aperture including an interior portion defined by the interior surface, an exterior portion defined by the exterior surface, and a ring dividing the interior portion from the exterior portion.

A wear member assembly according to an embodiment of the present disclosure may comprise a wear member having a body including a forward closed portion, a rear open portion defining a cavity, an exterior surface, an interior surface defining the cavity. A retaining mechanism receiving aperture may also be provided that include an interior portion defined by the interior surface, an exterior portion defined by the exterior surface, and a ring that divides the interior portion from the exterior portion. A retainer sleeve including a body including an at least partially annular configuration defining an axis of rotation, a radial direction, and a circumferential direction may also be provided. The retainer sleeve may include a radially inner annular surface defining a radially inner aperture, and the retainer sleeve may be disposed in the interior portion of the retaining mechanism receiving aperture with the ring radially overhanging the body of the retaining sleeve, and extending circumferentially an angle that is greater than 190.0 degrees.

DETAILED DESCRIPTION

Figure 1:
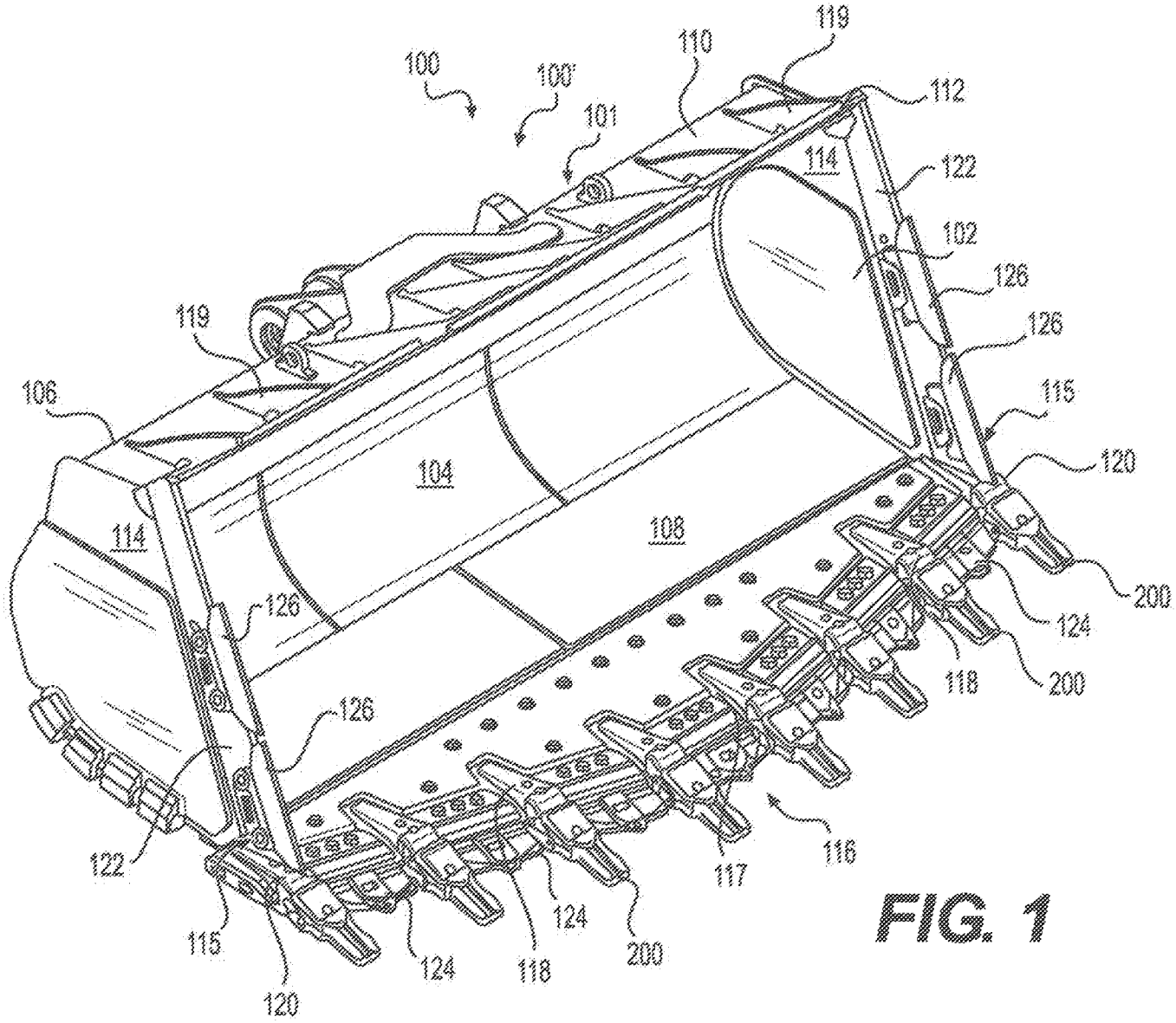
FIG. 1 is a perspective view of a work implement assembly such as a bucket assembly using tips, adapters, and retaining mechanisms with components configured according to various embodiments of the present disclosure.
Figure 2:
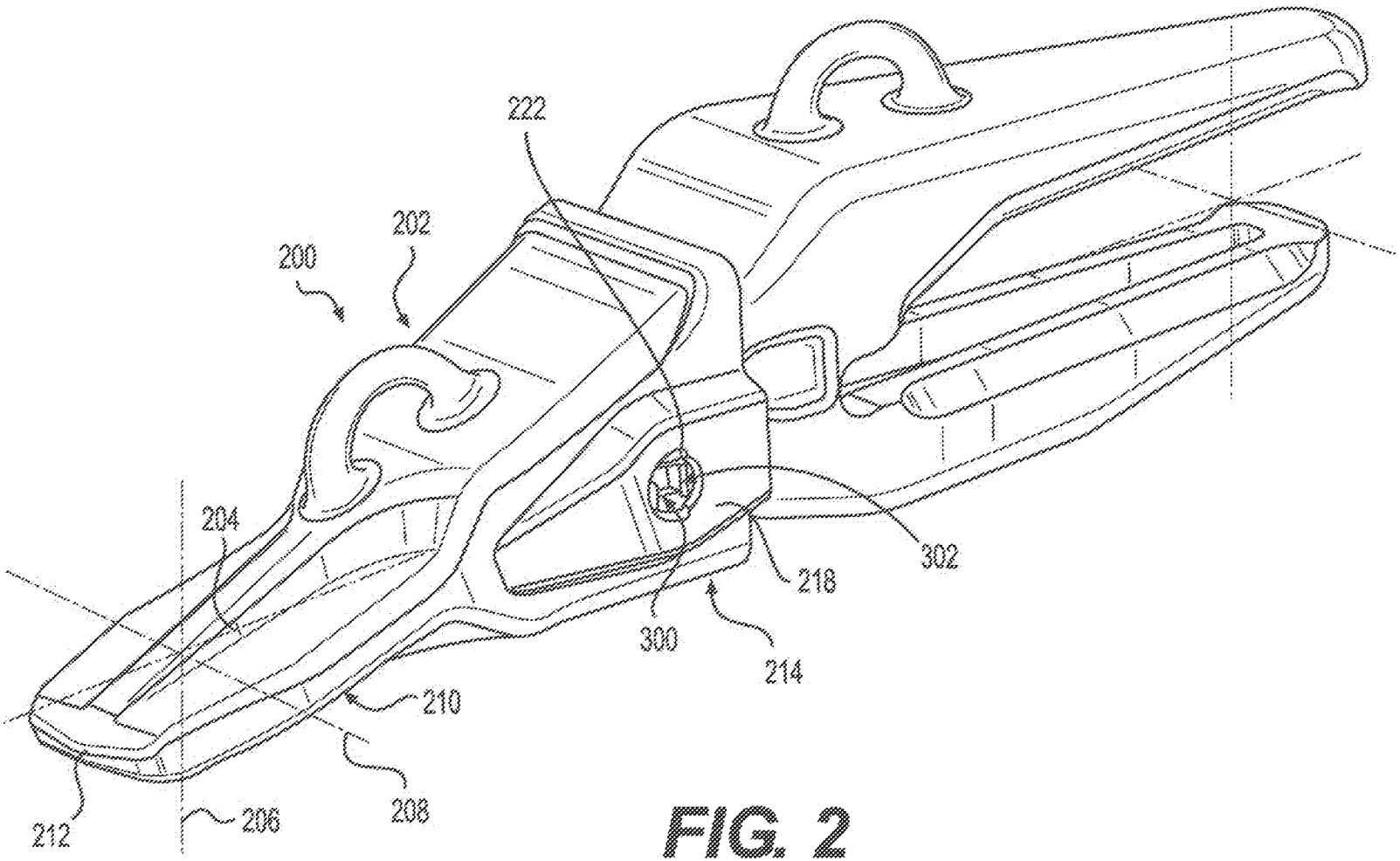
FIG. 2 is a perspective view of a tip and adapter subassembly of FIG. 1, shown in isolation from the work implement assembly of FIG. 1.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function such as is often the case when geometry is mirrored about a plane of symmetry. For ease of explanation in this specification, letters or primes will often not be included herein but may be shown in the drawings to indicate duplications of features discussed within this written specification.

A work implement assembly using tips according to various embodiments of the present disclosure will now be discussed.

Starting with FIG. 1, the work implement assembly 100 may take the form of a bucket assembly 100' that may be used by a wheel loader and that includes an enclosure 101 that defines an opening 102 that communicates with a generally enclosed interior. Starting from the rear of the bucket assembly 100 as shown in FIG. 1, the bucket assembly 100 includes a curved shell profile 104, which is attached to a rear wall 106 at the top end of the shell 104. The other end of the shell is attached to the bottom plate 108 of the assembly 100. A top plate 110 is attached to the top end of the rear wall 106. The top plate 110 transitions to a spill guard 112 that is designed to funnel material into the interior of the bucket and prevent material from spilling out of the bucket. Reinforcing ribs 119 are provided that are attached to the top plate 110 and the spill guard 112, providing reinforcement for strength. Two substantially flat end plates 114 are attached to the side edges of the spill guard 112, top plate 110, rear wall 106, bottom plate 108 and shell 104.

A side edge assembly 115 is attached to each end plate 114 while a front edge assembly 116 is attached to the front edge of the bottom plate 108 of the bucket assembly 100. The front edge assembly 116 includes a base edge 117 that is attached to the bottom plate 108, a plurality of center adapters 118 attached to the base edge 117, and a plurality of tips 200 (may also be referred to as tools, teeth, etc.) with each one of the plurality of tips 200 being attached to one of the plurality of center adapters 118. Also, two corner adapters 120 are also attached to the base edge and the side edges 122 of the bucket assembly 100'. Tip 200 may also be attached to the corner adapters 120.

Moreover, a plurality of base edge protectors 124 are also provided with each one of the base edge protectors 124 positioned between center adapters 120 and between a center adapter 120 and a corner adapter 120. A side edge protector 126 is also provided that is attached to the side edge 122 proximate to a corner adapter 120.

It is to be understood that the work implement assembly may take other forms other than a bucket assembly including rake assemblies, shear assemblies, etc. In addition, a differently configured bucket that is meant to be used by an excavator may also use various embodiments of a tip, retaining mechanism, adapter, spring, spring loaded retainer, tip assembly, and tip and adapter assembly, etc. as will be discussed herein.

In FIGS. 2 thru 5, the tip 200 may comprise a body 202 that defines a longitudinal axis 204, a vertical axis 206 that is perpendicular to the longitudinal axis 204, and a lateral axis 208 that is perpendicular to the vertical axis 206, and the longitudinal axis 204. The body 202 may include a forward working portion 210 disposed along the longitudinal axis 204 including a closed end 212, and a rear attachment portion 214 disposed along the longitudinal axis 204 including an open end 216.

The rear attachment portion 214 defines an exterior surface 218, an adapter nose receiving pocket 220 extending longitudinally from the open end 216, and a retaining mechanism receiving aperture 222 in communication with the adapter nose receiving pocket 220 and the exterior surface 218. An adapter nose lug receiving groove 224 may extend longitudinally from the open end 216 to the retaining mechanism receiving aperture 222. At least retainer sleeve receiving slot 226 may be in communication with the retaining mechanism receiving aperture 222 and the adapter nose receiving pocket 220.

Looking now at FIGS. 3 thru 6, a retainer and retainer sleeve assembly 300 according to an embodiment of the present disclosure will now be discussed. The assembly 300 may comprise a retainer 302 including a drive portion 304, and a lug receiving portion 306 defining a lug receiving slot 308 that extends partially through the lug receiving portion 306, forming a first sidewall 310, a second sidewall 312, and a catch surface 314 connecting the first sidewall 310 to the second sidewall 312. A skirt 316 at least partially defines the first sidewall 310, second sidewall 312, and catch surface 314 that terminates at a sloped face 318 that intersects with the first sidewall 310 (best seen in FIGS. 3 and 6). Another sloped face may be provided proximate to the second sidewall 312 in other embodiments of the present disclosure, but not necessarily so.

Figure 3:
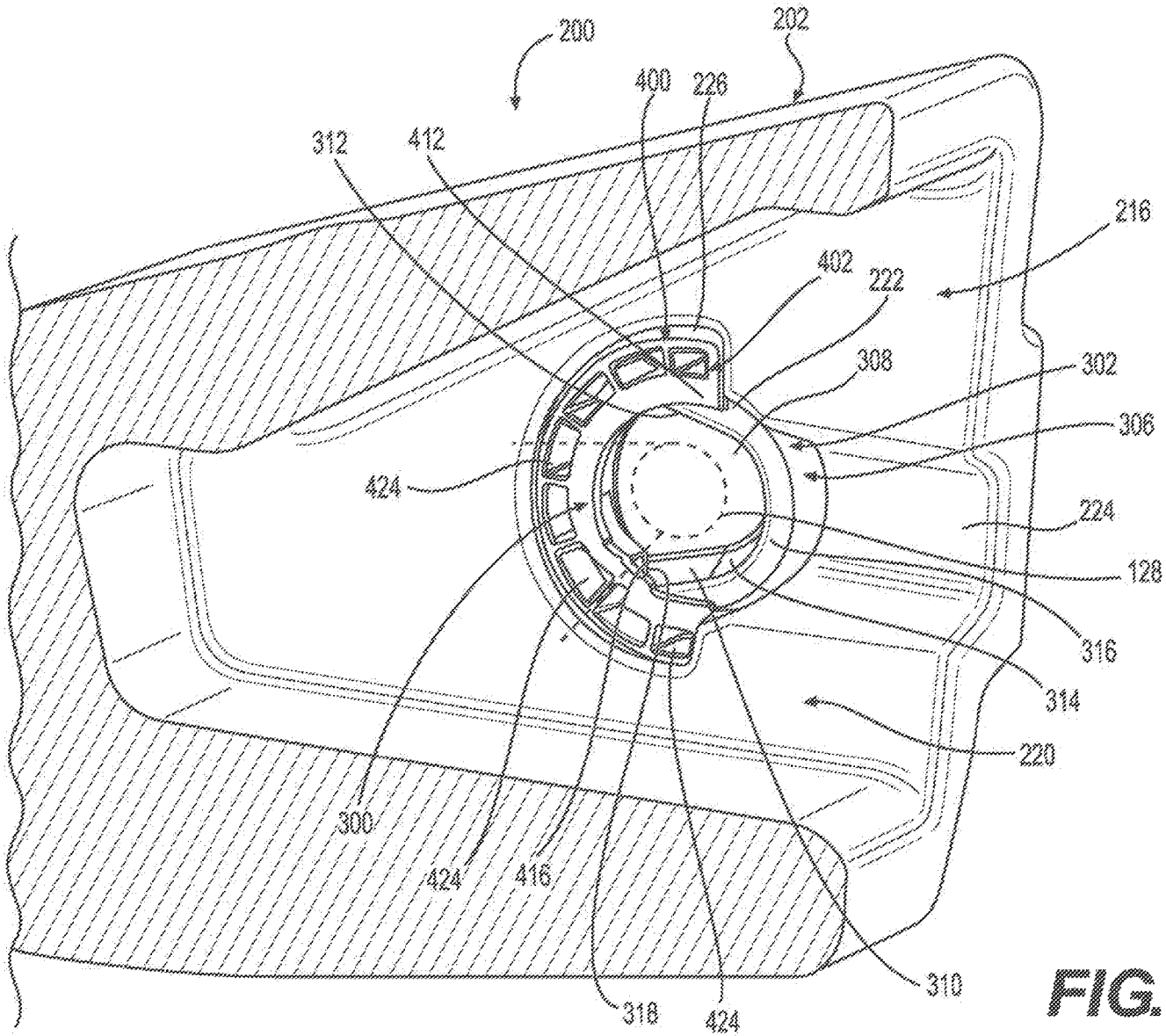
FIG. 3 is a side sectional view of the tip of FIG. 2 without the adapter, showing a retaining mechanism and its components including a retainer and a retainer sleeve with anti-rotation and retention features according to an embodiment of the present disclosure in a locked configuration.
Figure 5:
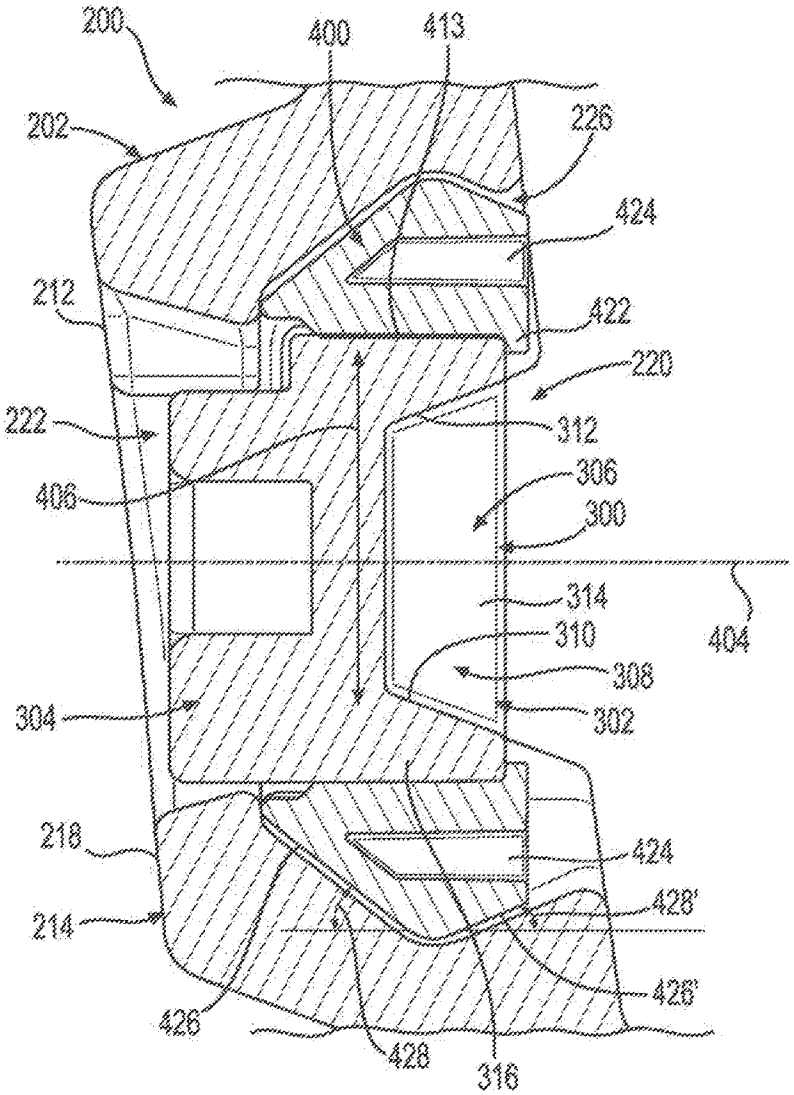
FIG. 5 is a partial rear sectional view of FIG. 2 illustrating a retaining mechanism and its components including the retainer and retainer sleeve with anti-rotation and retention features according to various embodiments of the present disclosure as assembled into the retaining mechanism receiving aperture of the tip. The retainer is shown in an unlocked configuration.
Figure 4:
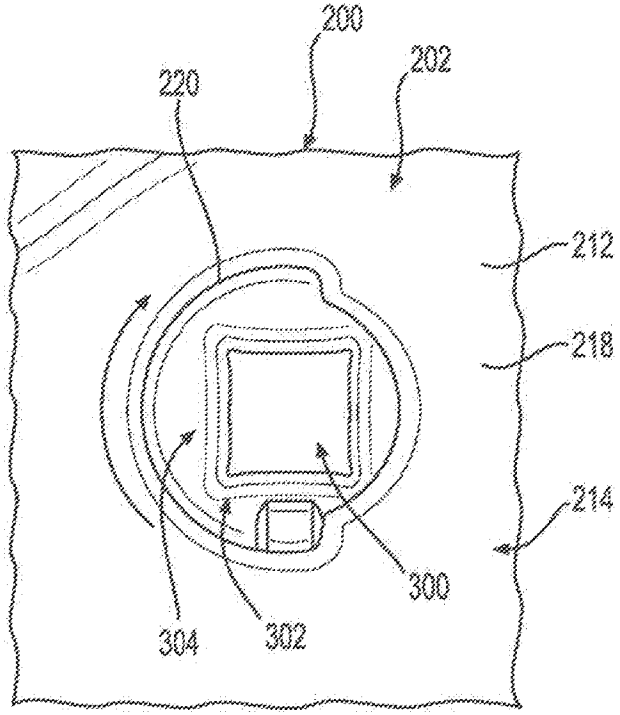
FIG. 4 is a side view of the tip of FIG. 2 showing the retainer being rotated from a locked to an unlocked configuration.

In FIG. 3, the outline of a lug 128 that is captured by the retainer and retainer sleeve assembly 300 is shown. It is to be understood that the retainer 302 is oriented as shown in FIG. 5 when the tip 200 is inserted over the nose of the adapter. The lug 128 passes first through the adapter nose lug receiving groove 224 and then into lug receiving slot 308 until is surrounded on three sides by the first sidewall 310, the second sidewall 312, and the catch surface 314. Then, the retainer 302 is rotated 180 degrees until the lug 128 is captured on all sides by the retainer 300 and the retainer sleeve 400 as shown in FIG. 3. Now, the tip is retained on the adapter. This process may be reversed to remove the tip from the adapter.

With continued reference to FIGS. 3 thru 6, a retainer sleeve 400 according to various embodiments of the present disclosure will now be discussed in the further detail. The retainer sleeve 400 may include a body 402 including an at least partially annular configuration (e.g., at least partially cylindrical, at least partially conical, etc.) defining an axis of rotation 404, a radial direction 402, and a circumferential direction 406 (best seen in FIG. 6). The axis of rotation 404 is so called for either or both of two reasons. First, at least some of the geometry of the retainer sleeve 400 (and by implication the retainer 302), may be modeled by rotating cross-sectional geometry about the axis of rotation 404. Second, the retainer 302 may be configured to be rotated about this axis of rotation 404. Other configurations are possible in other embodiments of the present disclosure.

Figure 6:
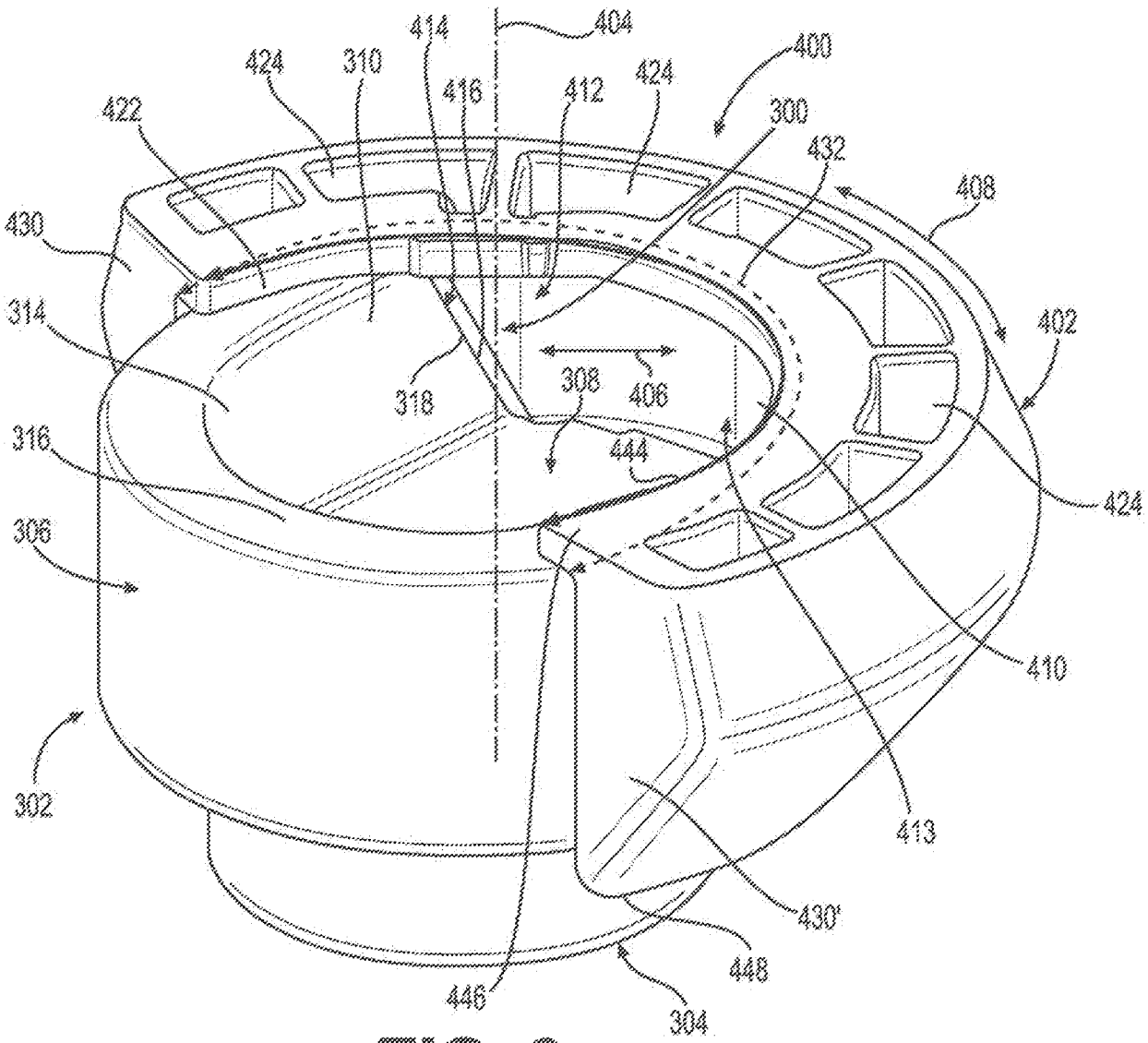
FIG. 6 is a top oriented perspective view of the retainer and retainer sleeve assembly employed in FIGS. 3 thru 5 removed from the tip for enhanced clarity.
Figure 7:
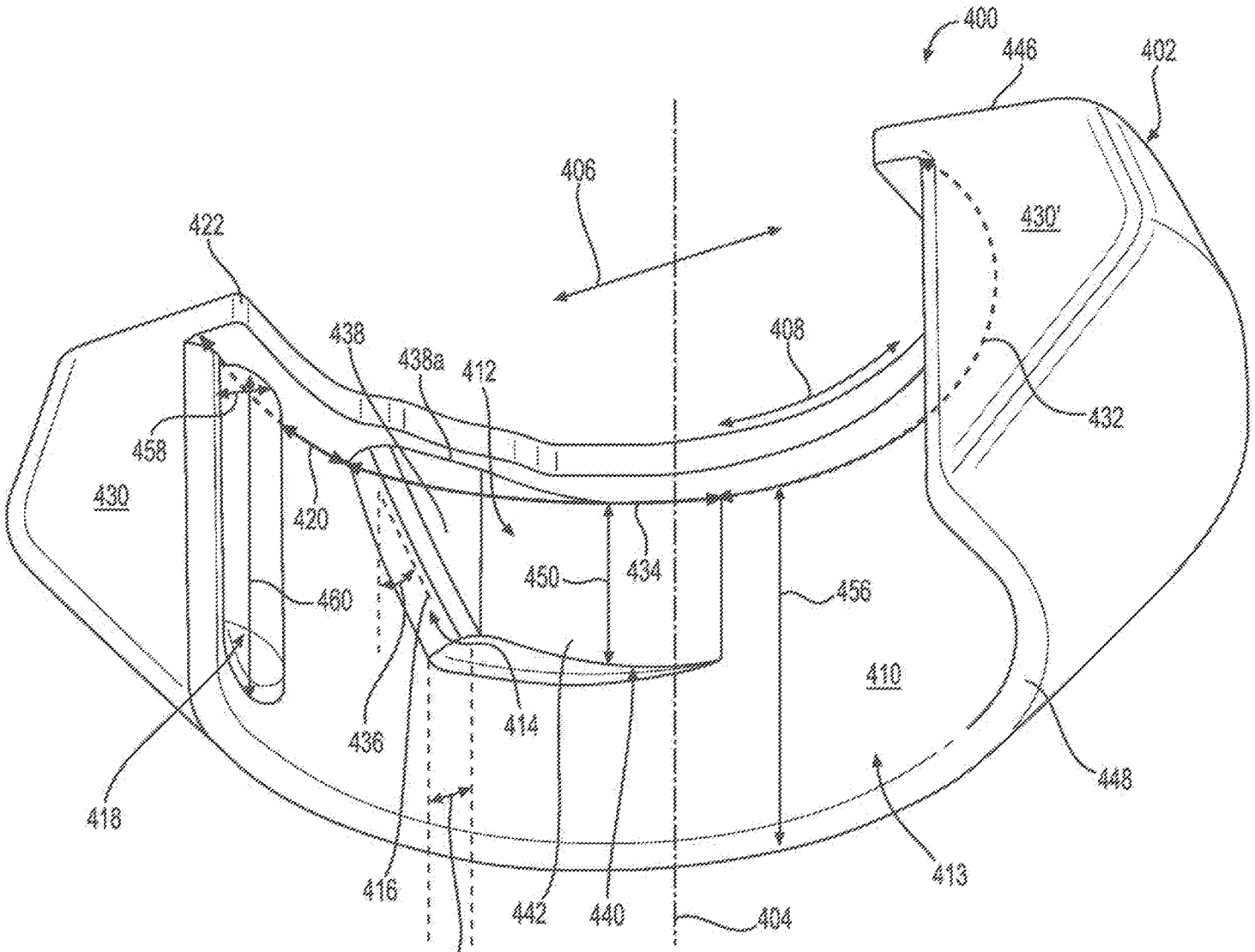
FIG. 7 is a bottom oriented perspective view of the retainer sleeve of FIG. 6 shown in isolation.
Figure 8:
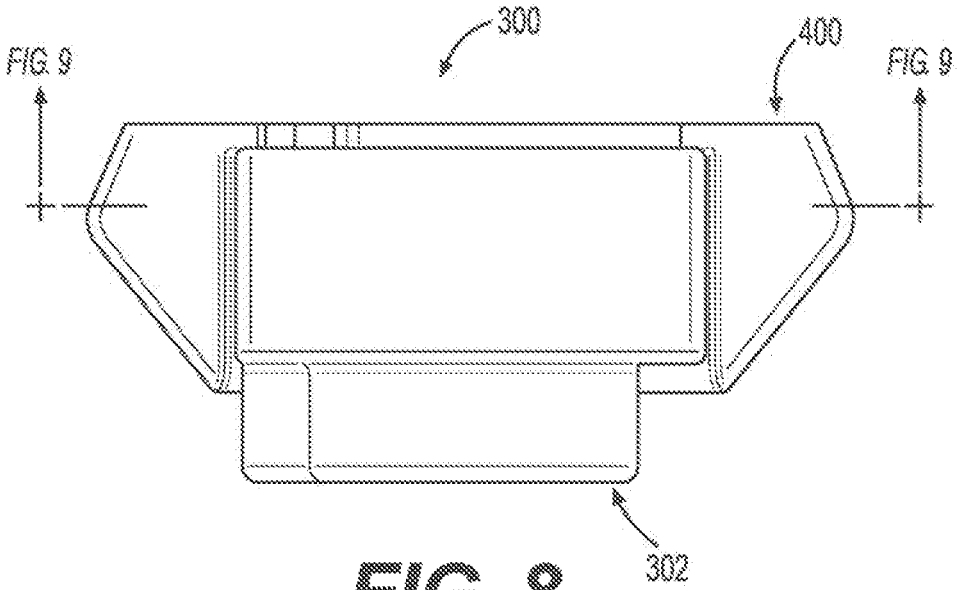
FIG. 8 is a front view of the retainer and retainer sleeve assembly of FIG. 6 with section lines for FIG. 9.
Figure 9:
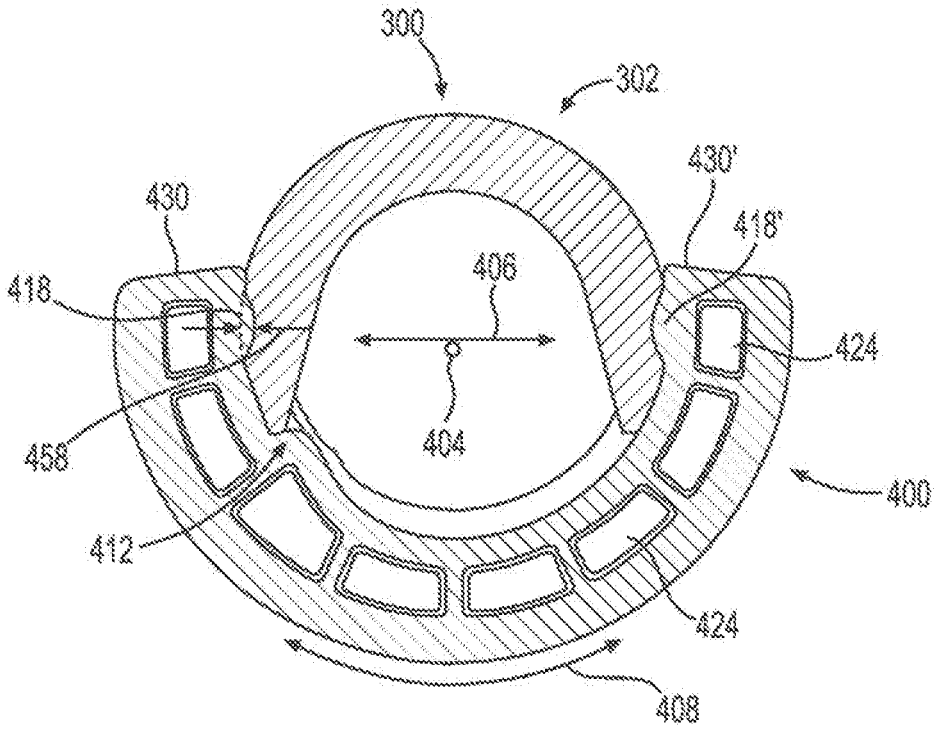
FIG. 9 is a top sectional view of the retainer and retainer sleeve assembly of FIG. 8 taken along lines 9-9 thereof.
Figure 10:
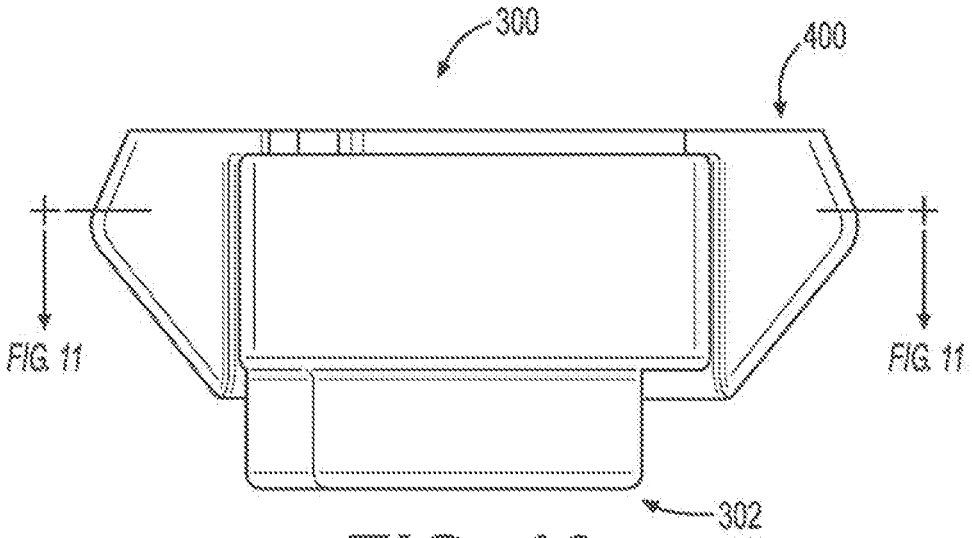
FIG. 10 is a front view of the retainer and retainer sleeve assembly of FIG. 6 with section lines for FIG. 11.
Figure 11:
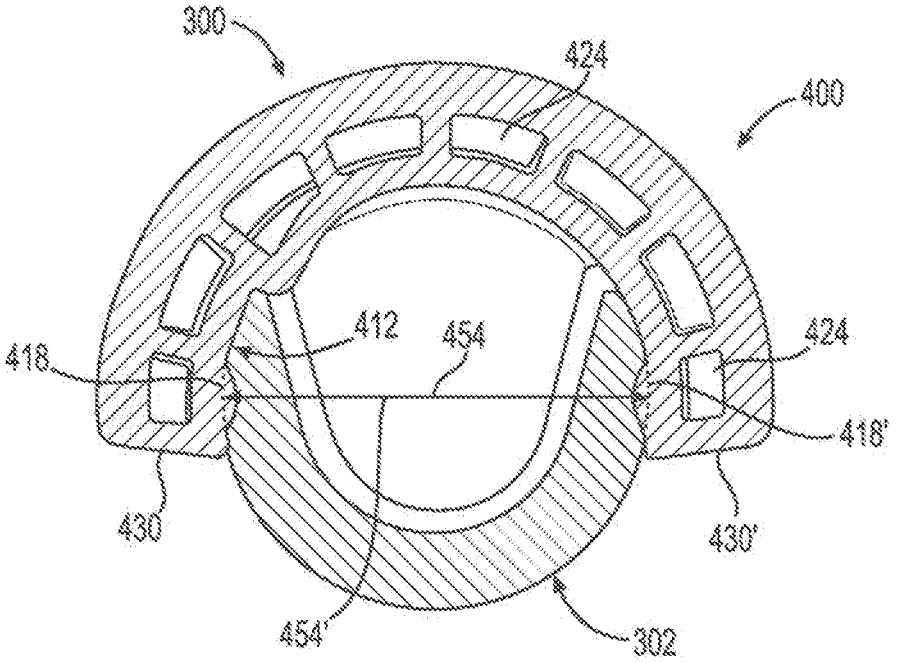
FIG. 11 is a bottom sectional view of the retainer and retainer sleeve assembly of FIG. 10 taken along lines 11-11 thereof.

As best seen in FIGS. 6 and 7, a radially inner annular surface 410 may define a radially inner aperture 413, and may include a first anti-rotation feature 412 extending radially inwardly from the radially inner annular surface 410. The first anti-rotation feature 412 may include a sloping ledge 414 having a locking surface 416 (see also FIG. 7) is at least partially complimentarily shaped to engage the sloped face 318 of the skirt 316 of the retainer 302. This locking surface 416 may be planar, slightly arcuate, etc.

Focusing on FIG. 7, the retainer sleeve 400 may further comprise a detent feature including a rib 418 extending radially inwardly from the radially inner annular surface 410. The rib 418 may be spaced circumferentially away a predetermined distance 420 from the first anti-rotation feature 412. The predetermined distance 420 is measured as an arc length from the rib 418 to the first anti-rotation feature 412 (e.g., to the locking surface) at the intersection of the lip 422 and the radially inner annular surface 410. The rib 418 may have a cylindrical, conical, or other arcuate configuration in various embodiments. In other embodiments, it may have a pointed shape, polygonal shape, etc. in a plane parallel with the radial direction 406.

The body 402 may be formed by molding a polyurethane material (e.g., thermoplastic injection molded, cast, cured, etc.). When molded, voids 424 may be provided in the design (see FIGS. 3, 5, 6, 9, and 11) that provide a more uniform wall thickness to help prevent the formation of voids, sinks, porosity, etc. in the body 402 resulting from the manufacturing process. The material, structure, or both of the body 402 may contribute to the resiliency of the body 402 so that the body 402 may deform and rebound. This is desirable when locking and unlocking the retainer 302 and when inserting the retainer sleeve 400 into the retainer sleeve receiving slot 226 of the tip 200 (see FIG. 5).

To that end, a pair of radially outer angled surfaces 426, 426' that form different draft angles 428, 428' with a direction parallel to the axis of rotation 404 in a plane containing the radial direction 406, and the axis of rotation 404 (see FIG. 5). These draft angles 428, 428' may be tailored so that it is easier to insert the retainer sleeve 400 into the slot 226 than to remove it. This helps to hold the retainer sleeve 400 in the slot 226, which in turn, helps hold the retainer 302 in the tip 200.

In FIGS. 6 and 7, the retainer sleeve 400 defines a first circumferential end 430 disposed along the circumferential direction 408, a second circumferential end 430' disposed along the circumferential direction 408. The rib 418 may be disposed proximate to the first circumferential end 430. A second rib 418' may be disposed proximate the second circumferential end 430' but not necessarily so (see FIGS. 9 and 11). The second rib 418' may be similarly, identically, or dissimilarly configured as the other rib 418 in various embodiments of the present disclosure. It should also be noted that only one anti-rotation feature is shown that is proximate to the first circumferential end, but is contemplated that another anti-rotation feature may be provided near the second circumferential end that is similarly, identically, or dissimilarly configured as the first anti-rotation feature in other embodiments of the present disclosure.

Still referring to FIGS. 6 and 7, the lip 422 extends radially and circumferentially past the rib 418, and the first anti-rotation feature 412, entirely overhanging the rib 418 and the first anti-rotation feature 412. This may not be the case in other embodiments of the present disclosure.

More particularly, the lip 422 extends from the first circumferential end 430 to the second circumferential end 430', defining a lip arc length 432 measured from the first circumferential end 430 to the second circumferential end 430' at the intersection of the radially inner annular surface 410 and the lip 422.

In certain embodiments a ratio of the lip arc length 432 to the predetermined distance 420 may range from 12.0 to 16.0, and the predetermined distance 420 may range from 3.0 mm to 9.0 mm.

Likewise, the first anti-rotation feature 412 may define a maximum circumferential dimension 434 measured as an arc length at the intersection of the radially inner annular surface 410, and the lip 422. A ratio of the lip arc length 432 to the maximum circumferential dimension 434 may range from 3.5 to 4.5, and the maximum circumferential dimension may range from 15.0 mm to 45.0 mm.

Any of these ranges of ratios or dimensions may be different than what has been specifically mentioned in other embodiments of the present disclosure.

Next, a retainer sleeve 400 according to various embodiments of the present disclosure that may be supplied as a replacement part will be discussed.

Looking at FIG. 7, the retainer sleeve may have a body 402 including an at least partially annular configuration (as previously described herein) defining an axis of rotation 404, a radial direction 406, and a circumferential direction 408. A radially inner annular surface 410 may defining a radially inner aperture 413. The first anti-rotation feature 412 may extend radially inwardly from the radially inner annular surface 410 including a sloping ledge 414 having a locking surface 416 that faces at least partially in the circumferential direction 408 and along a direction that is parallel to the axis of rotation 404, forming an oblique angle 436 with the direction that is parallel to the axis of rotation 404 in a plane perpendicular to the radial direction 406.

In certain embodiments, the oblique angle 436 may range from 50 degrees to 80 degrees and may at least partially match the angle of the sloped face 318 of the retainer 302 (see FIG. 6) as alluded to earlier herein. Also, the body 402 may comprise at least one of the following: a plastic, a rubber, an elastomer, a mesh structure (e.g., has voids), and a foam. This may help to make the body 402 resilient so that it can deform and rebound during the assembly, the locking, and the unlocking processes as discussed earlier herein.

With continued reference to FIG. 7, the first anti-rotation feature 412 may further include a cam surface 438 (may also be referred to as a first transitional surface) extending radially inwardly and circumferentially from the locking surface 416. A ramp 440 may also be provided that extends circumferentially from the cam surface 438 to the radially inner annular surface 412. As a result of the configuration of the locking surface 416, the cam surface 438, and the ramp 440, the cam surface 438 may have a triangular shape (e.g., a triangular perimeter 438*a*), and the ramp 440 may include an arcuate surface 442. Other configurations of these features are possible in other embodiments of the present disclosure. A discussion of the functions of these various features of the first anti-rotation feature 412 will be discussed later herein.

Looking at FIGS. 6 and 7, the at least partially annular configuration of the body 402 defines an angular extent 444 about the axis of rotation 404, a first axial end 446 that is disposed along the axis of rotation 404, and a second axial end 448 that is disposed along the axis of rotation 404. The body 402 may have a lip 422 that is disposed at the first axial end 446 extending along the entirety of the angular extent 444. This may not be the case in other embodiments of the present disclosure.

As alluded to earlier herein, the lip 422 may extend radially past the first anti-rotation feature 412. Also, the first anti-rotation feature 412 may extend axially away from the lip 422 toward the second axial end 448 defining a maximum axial dimension 450 of the first anti-rotation feature 412. Similarly, the first anti-rotation feature 412 also defines a maximum radial dimension 452 measured radially from the radially inner annular surface 410 to the radial extremity of the first anti-rotation feature 412. Moreover, the radially inner aperture 413 may define an inner diameter 454 (see FIG. 11), and a radially inner aperture axial depth 456 (see FIG. 7) measured axially from the lip 422 to the second axial end 448.

In certain embodiments, a ratio of the radially inner aperture axial depth 456 of the radially inner aperture 413 to the maximum axial dimension 450 of the first anti-rotation feature 412 may range from 1.5 to 2.5, and a ratio of the inner diameter 454 of the radially inner aperture 413 to the maximum radial dimension 452 of the first anti-rotation feature may range from 10.0 to 15.0. In such embodiments, the maximum axial dimension 450 may range from 7.0 mm to 16.0 mm, and the maximum radial dimension 452 may range from 2.0 mm to 5.0 mm.

Another retainer sleeve 400 according to another embodiment of the present disclosure may be described as follows with reference to FIG. 7.

The retainer sleeve 400 may include a body 402 including an at least partially annular configuration defining an axis of rotation 404, a radial direction 406, a circumferential direction 408, a first axial end disposed 446 along the axis of rotation 404, and a second axial end 448 disposed along the axis of rotation 404.

A radially inner annular surface 412 may define a radially inner aperture 413, a detent feature including a rib 418 extending radially inwardly from the radially inner annular surface 412. The rib 418 may define a rib radial height 458 (see also FIG. 9), and a lip 422 disposed at the first axial end 446 extending radially and circumferential past the rib 418. The rib 418 may extend axially from the lip 422 toward the second axial end 448, defining a rib axial length 460. Also, the radially inner annular surface 410 may define an inner diameter 454' (see FIG. 11), and a radially inner aperture axial depth 456 as mentioned just above herein.

In certain embodiments, a ratio of the radially inner aperture axial depth 456 to the rib axial length 460 may range from 1.5 to 1.0, and a ratio of the inner diameter 454' to the rib radial height 458 may range from 22.0 to 30.0. In such embodiments, the rib axial length 460 may range from 15.0 mm to 32.0 mm, and the rib radial height 458 may range from 1.0 mm to 3.0 mm.

Again, the body 402 may comprise at least one of the following: a plastic, a rubber, an elastomer, a mesh structure (e.g., a honeycomb like structure), and a foam, making the body 402 a resilient body.

Next, another embodiment of a retainer and retainer sleeve assembly 500 will be discussed looking FIGS. 12 thru 16. It should be noted that this assembly and its components may be similarly or identically configured as the assembly and its components discussed earlier herein with reference to FIGS. 3 thru 11 except possibly for the following differences. The body 602 of the retainer sleeve 600 may include an outer peripheral surface 662 and an array of a plurality of external ribs 664 extending outwardly radially from the outer peripheral surface 662, and may define a notch 666 that is radially aligned with the first anti-rotation feature 612.

Figure 15:
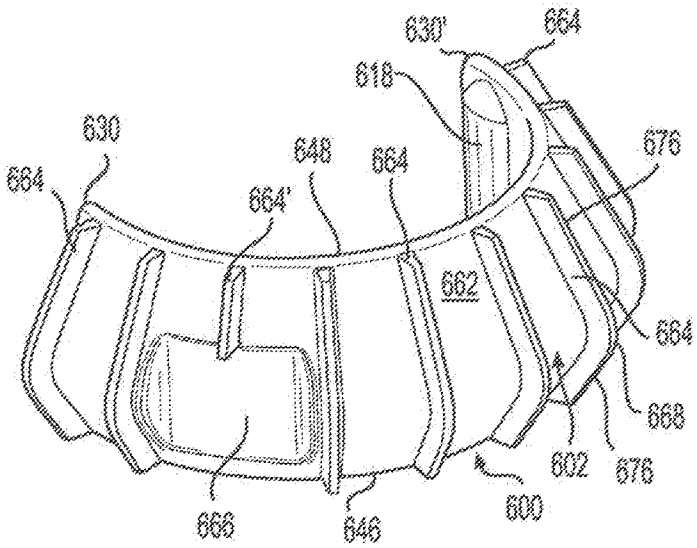
FIG. 15 is a perspective view of the retainer sleeve of FIG. 14 showing a notch on its outer peripheral surface configured to allow the retainer sleeve to move radially outwardly in the localized area of the first anti-rotation feature during rotation of the retainer.

In some embodiments as best seen in FIG. 15, at least one of the plurality of external ribs 664' may be disposed axially above the notch 666 and terminates axially short of the notch 666. This notch 666 may be shaped to allow the retainer sleeve 600 to move radially outwardly in the localized area of the first anti-rotation feature 612 when locking or unlocking the retainer in the pocket (also referred to as the retaining mechanism receiving aperture earlier herein) of the tip during assembly. The external rib 664' may provide some rigidity to the retainer sleeve 600 during the locking and unlocking operations near the first anti-rotation feature 612 by reducing the amount of clearance 518 located between the retainer sleeve 600 and the walls of this pocket (see FIG. 13). This may be helpful when the pocket is oversized, etc.

Figure 13:
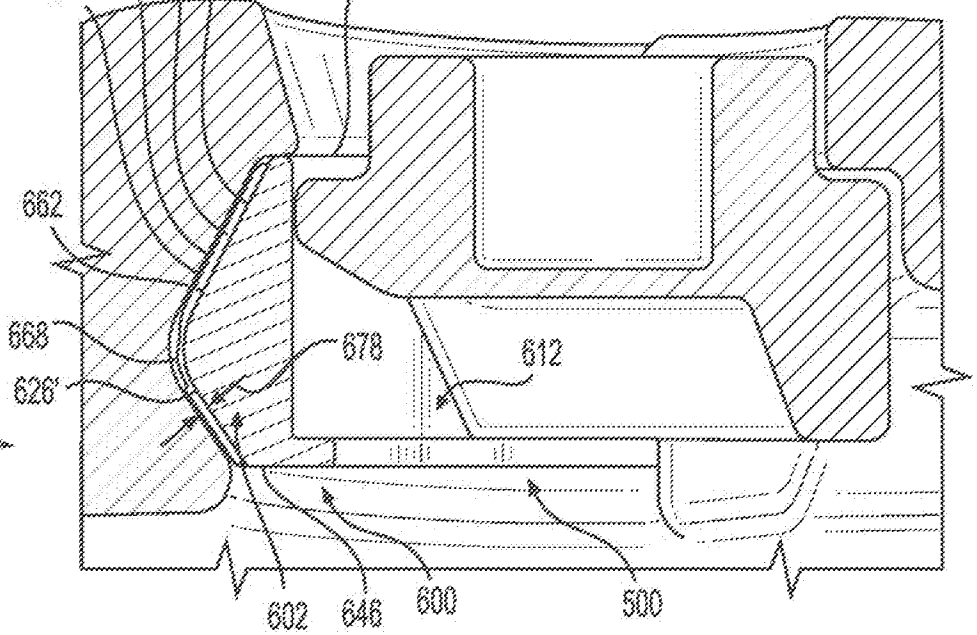
FIG. 13 is top sectional view of the tip and retaining mechanism of FIG. 12 showing the retainer engaging the first anti-rotation feature.
Figure 12:
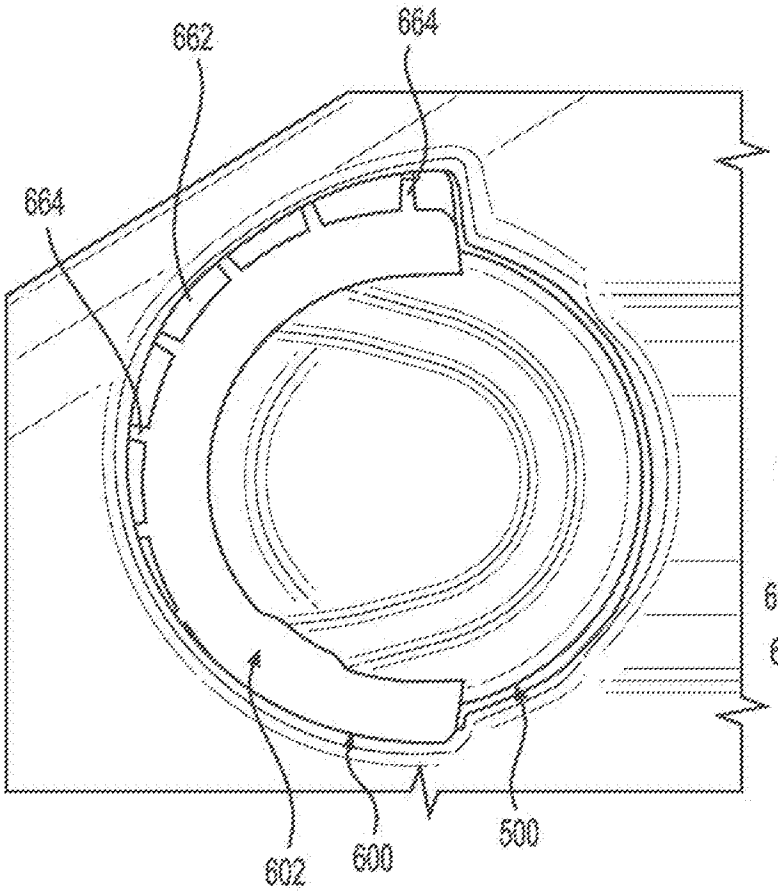
FIG. 12 is a side view of a tip without an adapter, showing another embodiment of the retaining mechanism including a retainer and a retainer sleeve with external ribs according to various principles of the present disclosure. The retaining mechanism is shown in the locked configuration.
Figure 14:
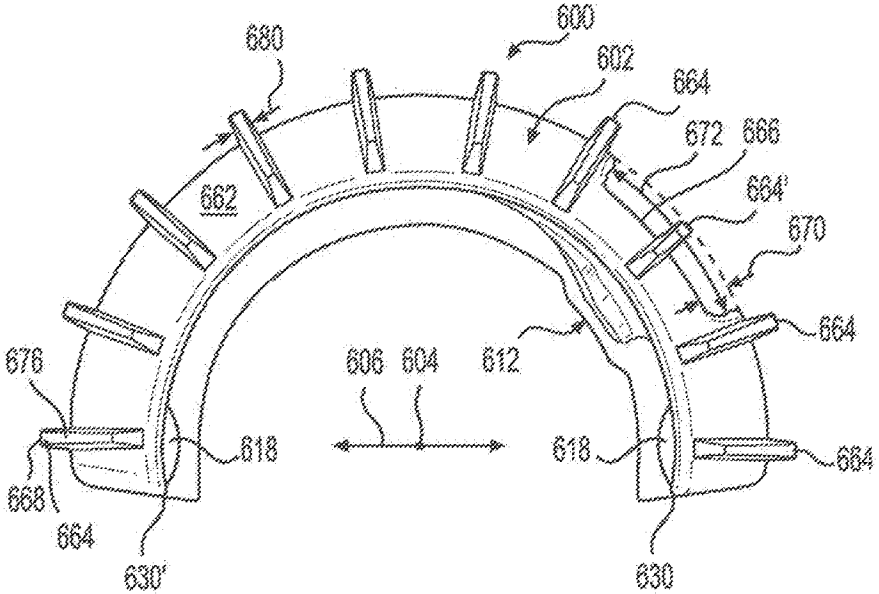
FIG. 14 is a rear view of the retainer sleeve of FIG. 12 shown in isolation.

As best seen in FIG. 14, at least one of the plurality of external ribs 664 may be disposed proximate to the first circumferential end 630 and/or the second circumferential end 630'. In such a case, the at least one external rib 664 that is disposed proximate to the first circumferential end 630 and/or second circumferential end 630' may extend from the first axial end 646 to the second axial end 648 (i.e., at least 90% of the axial height of the retainer sleeve as best seen in FIG. 13). This may not be the case in other embodiments of the present disclosure.

With continued reference to FIG. 13, at least one of the plurality of external ribs 664 define contact surfaces 676 that are offset from the pair of angled surfaces 626, 626', yielding a V-shaped configuration with a vertex 668 that may or may not be truncated or decreased in size. In some embodiments, the V-shaped configuration of the external ribs 664 may be split into an upper portion and a lower portion by providing a gap between the upper portion and the lower portion if desired.

Figure 16:
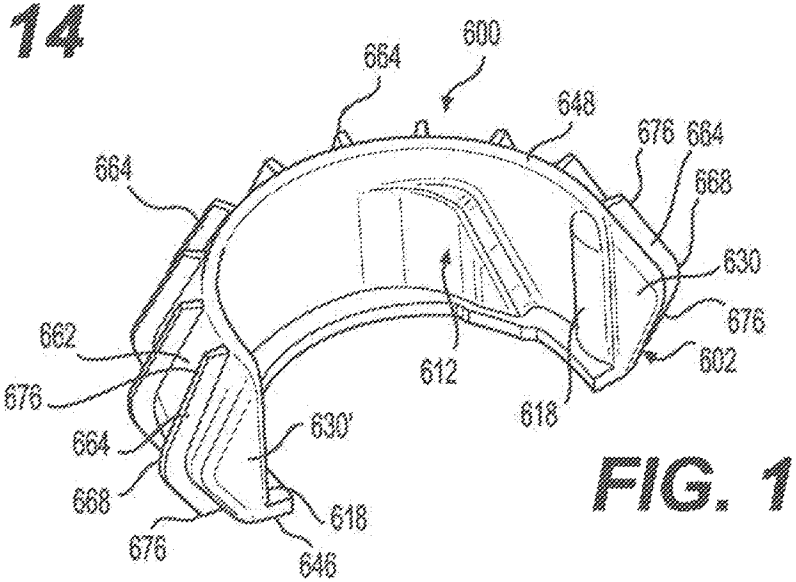
FIG. 16 is an alternate perspective view of the retainer sleeve of FIG. 15 showing the presence of anti-rotation features similar or identical to those present in FIGS. 3 thru 11.
Figure 17:
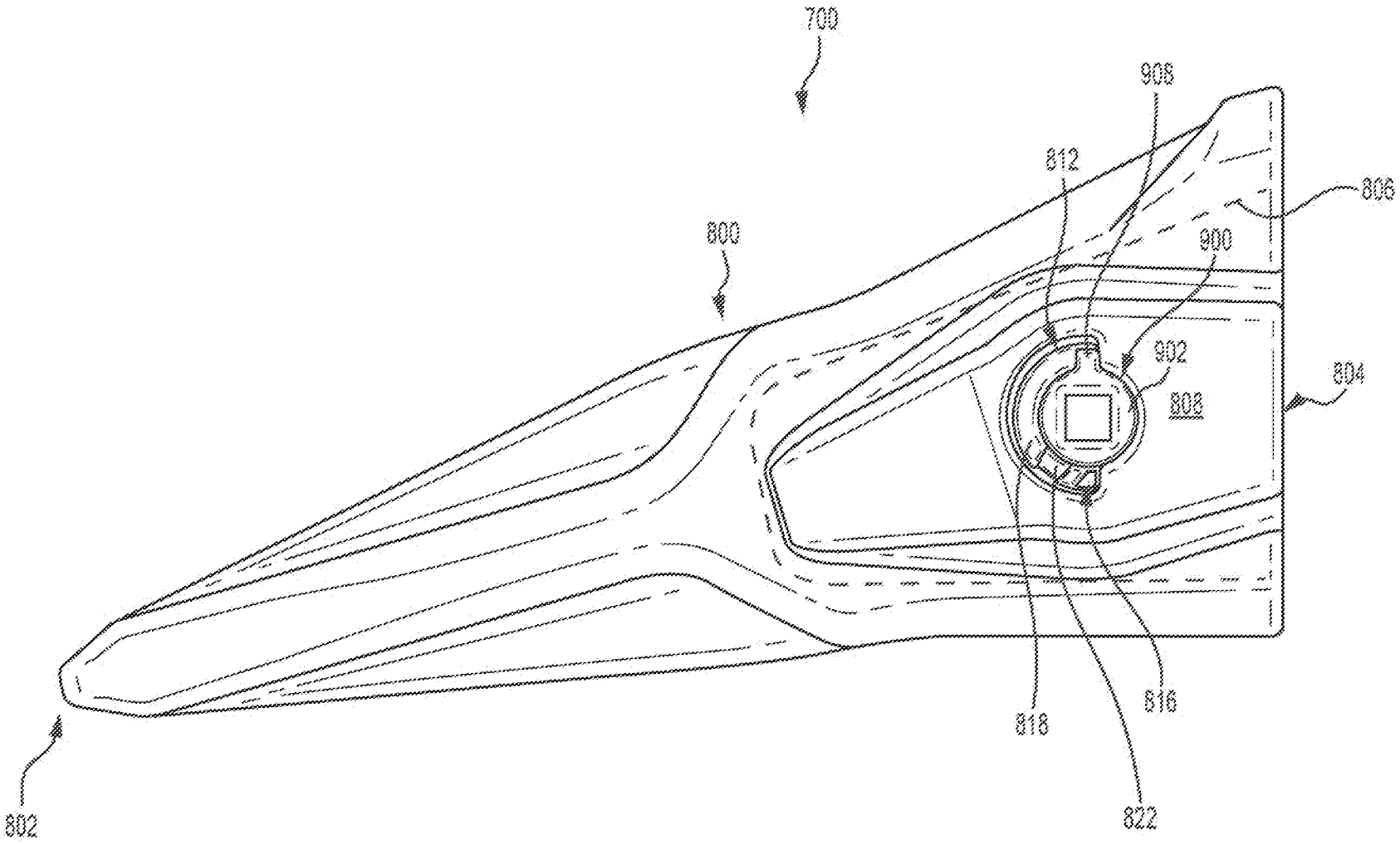
FIG. 17 is a side view of a wear member assembly in the form of a tip that includes a retaining mechanism disposed in its pocket with anti-tipping features according to yet another embodiment of the present disclosure. The anti-tipping features include a ring in the pocket of the tip with a gap for receiving a hook tab for the retainer (or lock) during assembly.

Focusing now at FIGS. 14 thru 16, a retainer sleeve 600 according to another embodiment of the present disclosure that may be provided as a replacement part will now be described. As just alluded to herein, the outer peripheral surface 662 may define a notch 666 that is at least partially radially aligned with the first anti-rotation feature 612. It should be noted that the outer peripheral surface 662 may be differently configured than shown. As such, the outer peripheral surface 662 may be constitute a single cylindrical surface, a single conical surface, etc. The notch 666 may have a radial notch depth 670 (see FIG. 14) ranging from 1.0 mm to 5.0 mm and a circumferential notch width 672 in certain embodiments of the present disclosure. An external rib 664 may be on each circumferential side 674 of the notch 666 (e.g., straddling the notch) but not necessarily so. In other words, at least one of the plurality of external ribs 664 may be disposed circumferentially proximate to the notch. This notch may be omitted entirely in other embodiments of the present disclosure.

At least one external rib 664' may extend from the outer peripheral surface that is disposed axially above the notch 666. An array of a plurality of external ribs 664 may be arranged circumferentially about the axis of rotation 604. One or all of the external ribs 664, 664' may be omitted in other embodiments of the present disclosure.

When such external ribs 664 are provided, an external rib 664 may be disposed proximate the first circumferential end 630 and another external rib 664 may be disposed proximate to the second circumferential end 630'. This may not be the case in other embodiments of the present disclosure. Also, at least one of the plurality of external ribs 664 may be radially aligned with an internal rib 618 that acts a detent feature. This may not be the case for other embodiments of the present disclosure.

As alluded to earlier herein, the outer peripheral surface 662 may include a pair of angled surfaces 626, 626', and at least one of the plurality of external ribs 664 includes a contact surface 676 that is offset from at least one of the pair of angled surfaces 626, 626' an offset distance 678 (see FIG. 13) ranging from 1.0 mm to 3.0 mm. At least one of the plurality of external ribs 664 includes a v-shaped configuration in a plane containing the axis of rotation 604 and the radial direction 606. At least one of the plurality of external ribs 664 extends from the first axial end 646 to the second axial end 648 but not necessarily so. Also, at least one of the plurality of external ribs 664 defines a rib thickness 680 (minimum dimension measured along a direction perpendicular to the radial direction 606, see FIG. 14) ranging from 0.5 mm to 3.0 mm in some embodiments.

Again, it should be noted that any of the ranges of ratios, dimensions, angles, surface areas and/or configurations of various features may be varied as desired or needed including those not specifically mentioned herein. Although not specifically discussed, blends such as fillets are shown to connect the various surfaces. These may be omitted in other embodiments and it is to be understood that their presence may be ignored sometimes when reading the present specification unless otherwise specifically mentioned.

INDUSTRIAL APPLICABILITY

In practice, a machine, a work implement assembly, a tip assembly or a wear member assembly, a tip and adapter assembly, a retainer sleeve, a retainer and retainer sleeve assembly and/or any combination of these various assemblies and components may be manufactured, bought, or sold to retrofit a machine or a work implement assembly in the field in an aftermarket context, or alternatively, may be manufactured, bought, sold or otherwise obtained in an OEM (original equipment manufacturer) context.

Any of the aforementioned components may be made from any suitable material including iron, grey-cast iron, steel, plastic, rubber, foam, etc.

The features of the retainer sleeve and retainer as previously described herein may operate as follows to facilitate a robust locked configuration and a less robust unlocked configuration.

First, (best understood with reference to FIG. 5) the retainer 302 and the retainer sleeve 400 are snapped into the retainer sleeve receiving slot 226, and the retaining mechanism receiving aperture 222. The construction of the retainer sleeve 400 is such that it is resilient enough to deform locally and/or as a whole so that it can be snapped into the retainer sleeve receiving slot 226 and rigid enough to remain therein. The lip 422 of the retainer sleeve 400 holds the retainer 302 axially in place. The lip 422 extends completely around the perimeter of the retainer sleeve 400 to provide robust axial retention of the retainer 302 in the retaining mechanism receiving aperture 222.

As can be appreciated by FIGS. 3, 6, 7, 9 and 11, the rib 418 of the detent feature provides a slight retaining force to hold the retainer 302 in the locked and/or unlocked position. This slight retaining force may be easily overcome by inserting a tool into the drive portion 304 of the retainer 302. The first anti-rotation feature 412 provides a more robust retaining force than the detent feature. Hence, one skilled in the art might refer to the first anti-rotation feature 412 as a primary device for preventing rotation of the retainer 302 while the detent feature might be referred to as a secondary device for preventing rotation of the retainer 302 from the locked to unlocked configuration.

As best understood with reference to FIG. 7, the first anti-rotation feature 412 includes a ramp 440 with a greater circumferential extent than that the cam surface 438, and the locking surface 416. Accordingly, the force required to rotate the retainer 302 from the unlocked configuration to the locked configuration is less than what is required to unlock the retainer 302.

More specifically, the wedge or cam effect provided by ramp 440 as it contacts the skirt 316 of the retainer 302 spreads apart the retainer sleeve 400 into the clearance (part of 226) found between the tip 202 and the retainer sleeve 400 (as well as providing local deformation) more easily than when the process is reversed to achieve an unlocked configuration.

When the retainer 302 is rotated from the locked position to the unlocked position, the oblique angle 436 of the locking surface 416 provides less of a wedge or cam effect to spread the retainer sleeve 400 open. If enough force is exerted, the skirt 316 of the retainer 302 eventually contacts the cam surface 438, which primarily deflects the first anti-rotation feature 412 radially outwardly into a void 424. The retainer 302 may then be more easily rotated to achieve the unlocked configuration. Hence, the likelihood of the undesired rotation of the retainer 302 from the locked to unlocked configuration is lessened.

In some applications, the pocket for receiving the retaining mechanism may be oversized. In such a case, the retainer sleeve 600 as shown and described herein with reference to FIGS. 12 thru 16 may be employed. To that end, the number and size of the external ribs may be adapted to provide the suitable amount of rigidity of the sleeve while also removing some or all of the slop or clearance between the retainer sleeve and the walls of the pocket. In some applications where the pocket is smaller, the external ribs may deform to fit into the pocket. The external ribs may also provide a centering function in the pocket, etc.

In the same or other applications, it may be desirable to provide a notch to allow the retainer sleeve to flex locally in the pocket of the tip proximate to the first anti-rotation feature during rotation of the retainer.

As alluded to earlier herein, it may be desirable to have embodiments that are less inclined to tip or cock the retainer in the pocket of a tip or other wear member. Such embodiments are shown, but not limited to, FIGS. 17 thru 24. It is to be understood that any of the embodiments and their features shown in FIGS. 17 thru 24 may be added to or in lieu of the features of the embodiments discussed previously herein, and vice versa. Similar or identical materials and manufacturing processes may be used to fabricate all the embodiments discussed herein.

Looking at FIGS. 17 thru 21, a wear member assembly 700 constructed in such a manner may comprise a wear member 800 itself that has a body including a forward closed portion 802, a rear open portion 804 defining a cavity 806, an exterior surface 808, and an interior surface 810 defining the cavity 806. The wear member may take any suitable shape and form and includes tips or other work tool members that may be attached to a work implement, such as a bucket, to perform work on a work material such as the ground, etc. Alternatively, or in addition, the wear member may take the form of a shroud, a base edge protector, etc. or any other member that is intended to protect the work implement from wear but not necessarily perform work on a work material such as the ground, etc. Accordingly, the cavity of the rear open portion may have an enclosed perimeter or may be a lateral thru-slot, etc.

The wear member 800 may also define a retaining mechanism receiving aperture 812 including an interior portion 814 (see FIG. 20) defined by the interior surface 810, an exterior portion 816 defined by the exterior surface 808. A ring 818 (may also be referred to as a "rib", a "ledge", etc.) at least partially divides the interior portion 814 from the exterior portion 816.

Figure 21:
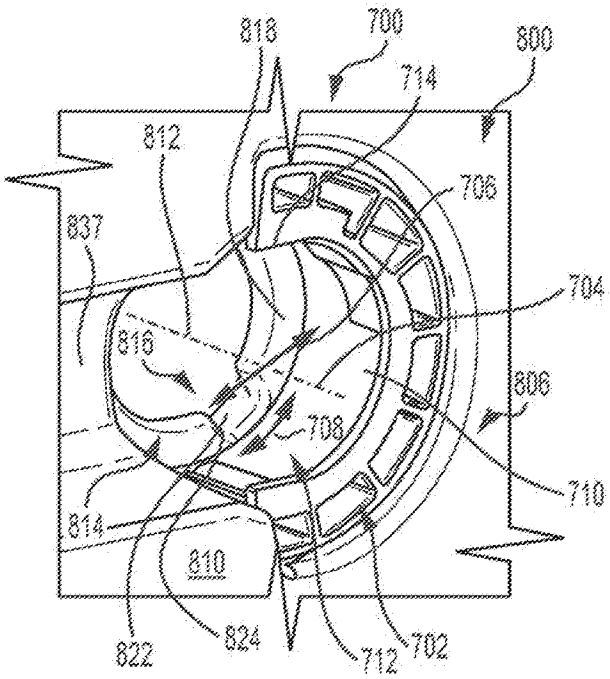
FIG. 21 is an interior perspective view of the wear assembly of FIG. 20 with the retainer removed for enhanced clarity.
Figure 20:
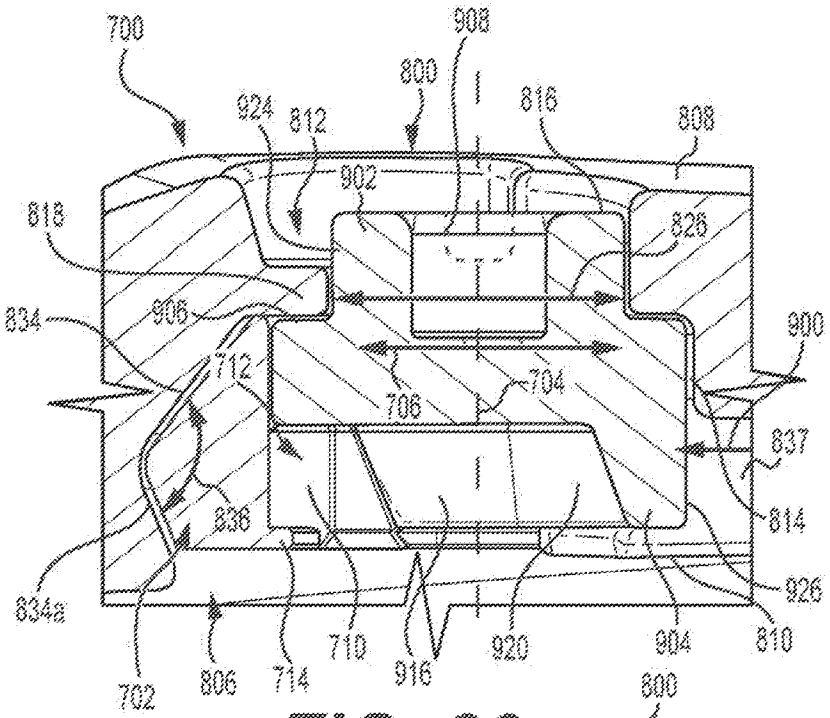
FIG. 20 is a sectional view of the wear member assembly of FIG. 17 taken along lines 20-20 thereto, illustrating the retention of the retainer in the pocket of the tip via the retainer sleeve.

As best seen in FIGS. 20 and 21, a retainer sleeve 702 may be provided that is constructed in a manner consistent with any of the embodiments of a retainer sleeve discussed herein. Accordingly, the retainer sleeve 702 may include a body having an at least partially annular configuration defining an axis of rotation 704 (so called since the shape allows the rotation of the retainer as previously described herein), a radial direction 706, and a circumferential direction 708.

Specifically, this annular configuration may be at least partially defined by a radially inner annular surface 710 (e.g., a conical surface, a cylindrical surface, a polygonal surface, etc.) defining a radially inner aperture 712. The retainer sleeve 702 may be disposed in the interior portion 814 of the retaining mechanism receiving aperture 812 with the ring 818 radially overhanging the body of the retaining sleeve 702. The ring 818 may extend circumferentially about the axis of rotation 704 an angle 820 (see FIG. 18) that is greater than 190.0 degrees. More specifically, the angle 820 may be greater than 270.0 degrees, or may range from 345.0 degrees to 355.0 degrees (with a nominal value of 350.0 degrees). These features and angles may be different in other embodiments of the present disclosure. When present, extra guidance for the retainer may thus be provided by the increased ring that helps to prevent tipping or cocking of the retainer in use.

In FIG. 21, it can be seen that the ring 818 defines a thru-slot 822 that is in communication with the interior portion 814, and the exterior portion 816 (see FIGS. 17 thru 20) of the retaining mechanism receiving aperture 812. As seen in FIG. 21, the thru-slot 822 extends radially outwardly short of the radially inner annular surface 710 of the retainer sleeve 702. This may not be the case for other embodiments of the present disclosure. Also, the thru-slot 822 may define at least partially a polygonal perimeter 824 (e.g., a rectangular perimeter, etc.) projected onto a plane that is perpendicular to the axis of rotation 704. Other configurations are possible in other embodiments of the present disclosure. As seen in FIG. 20, the ring 818 may define an inner diameter 826 that is concentric with the radially inner annular surface 710 of the retainer sleeve 702.

Figure 19:
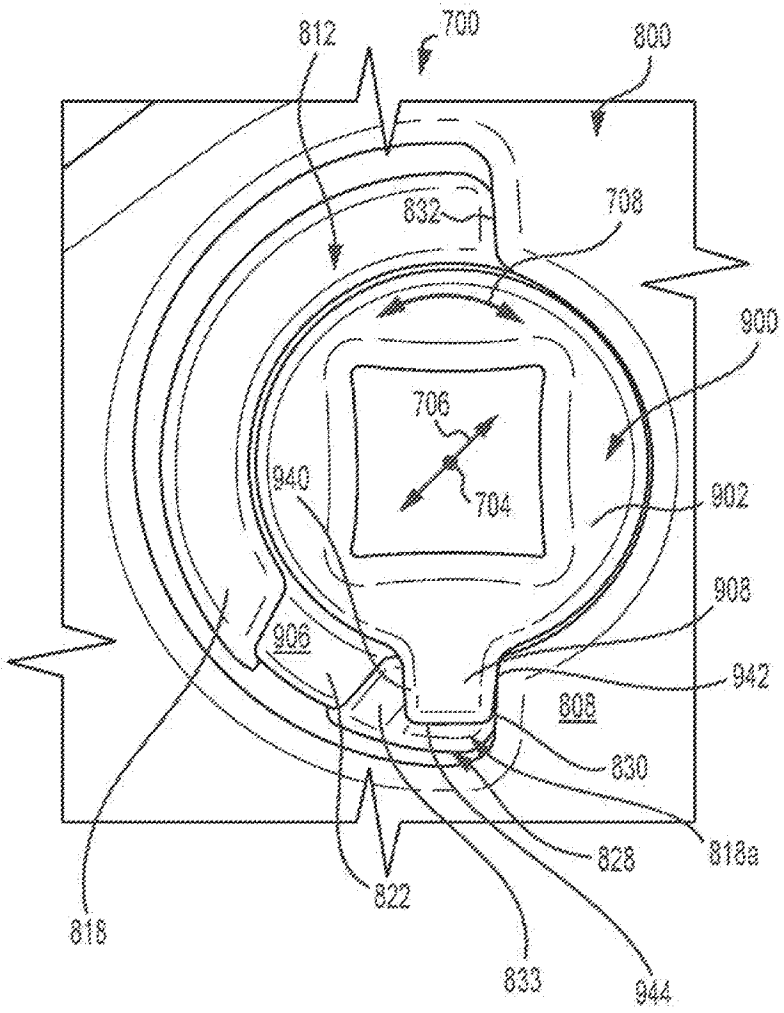
FIG. 19 shows the retainer mechanism of FIG. 18 rotated to the unlocked position.
Figure 18:
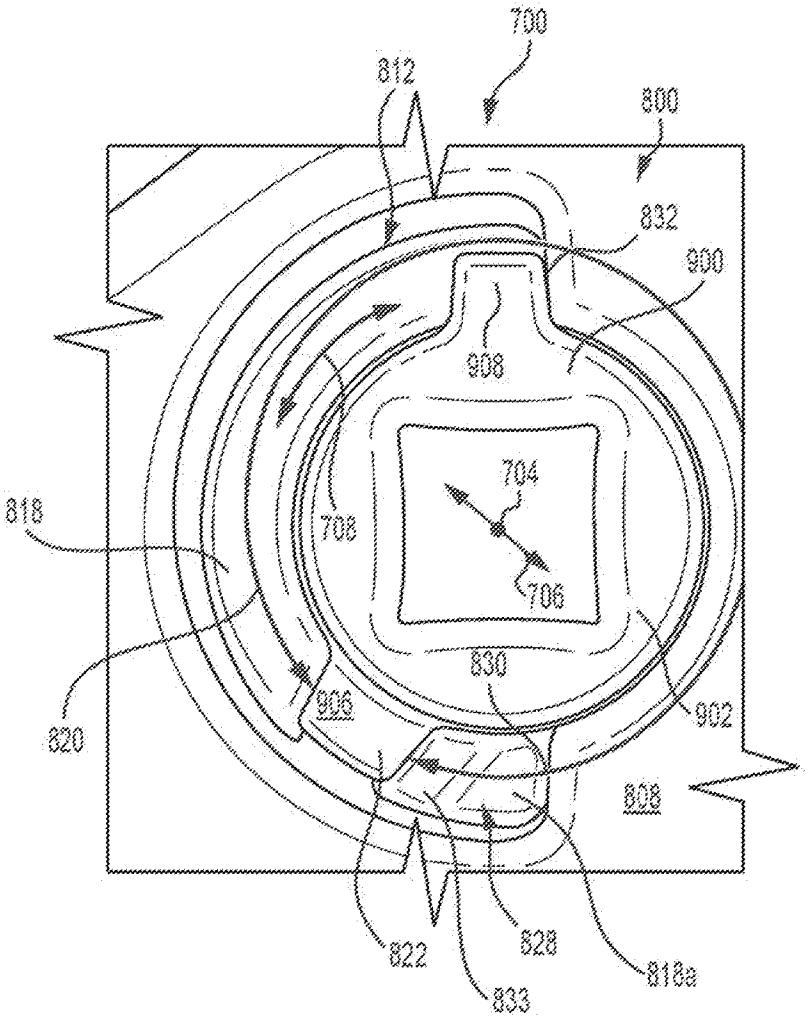
FIG. 18 is an enlarged view of the retainer mechanism of FIG. 17 shown in the locked position.

Referring now to FIGS. 18 and 19, the thru-slot 822 may be in communication with a hook tab receiving slot 828 of the exterior portion 816 of the retaining mechanism receiving aperture 812. The hook tab receiving slot 828 may be delimited circumferentially by a first stop surface 830 and a second stop surface 832 (so called since the rotation of the retainer 900 is limited by these surfaces as the hook tab 908 abuts them). The thru-slot 822 may be spaced circumferentially away from the first stop surface 830 with a ring portion 818*a* disposed between the first stop surface 830, and the thru-slot 822. This feature may be omitted in other embodiments of the present disclosure.

Moreover, a ramp 833 may be situated on the ring portion 818*a* facing toward the exterior surface 816 that extends circumferentially from the thru-slot 822 toward the first stop surface 830. This ramp may help seat the retainer and the retainer sleeve as the retainer is rotated, forcing them axially toward the exterior. This ramp may be omitted in other embodiments of the present disclosure. In yet further embodiments, the ramp may be located circumferentially between the thru-slot and the second stop surface, etc.

FIG. 20 depicts that the interior portion 814 of the retaining mechanism receiving aperture 812 includes a pair of radially angled surfaces 834, 834*a*, forming an obtuse angle 836 relative to each other, forming an undercut along the axis of rotation 704. This feature helps hold the retainer and the retainer sleeve in place in a manner discussed earlier herein. To that end, the retainer sleeve includes a pair of radially outer surfaces that are complementarily shaped to the radially angled surfaces of the interior portion of the retaining mechanism receiving aperture.

Also, and a lug receiving groove 837 (see also FIG. 21) may extend from the interior portion 814 of the retaining mechanism receiving aperture 812 to the exterior surface in a manner previously discussed herein for receiving the lug of an adapter during assembly. These features may be differently configured or omitted altogether in other embodiments of the present disclosure.

With continued reference to FIG. 20, a retainer 900 may be part of the assembly 700. The retainer 900 may have a drive portion 902 that extends axially past the ring 818 of the wear member 800 toward the exterior surface 808. The retainer 900 may also include a skirt 904 that is interposed axially between the ring 818 of the wear member 800 and a lip 714 of the retainer sleeve 702. The ring 818 of the wear member 800 may be configured to axially contact the skirt 904 at its top annular face 906.

Looking at FIGS. 17 thru 19, 22, and 24, it can be seen that the retainer 900 further includes a hook tab 908 that extends radially from the drive portion 902, forming a passageway 910 (see FIG. 24) extending circumferentially between the hook tab 908 and the skirt 904.

Figure 22:
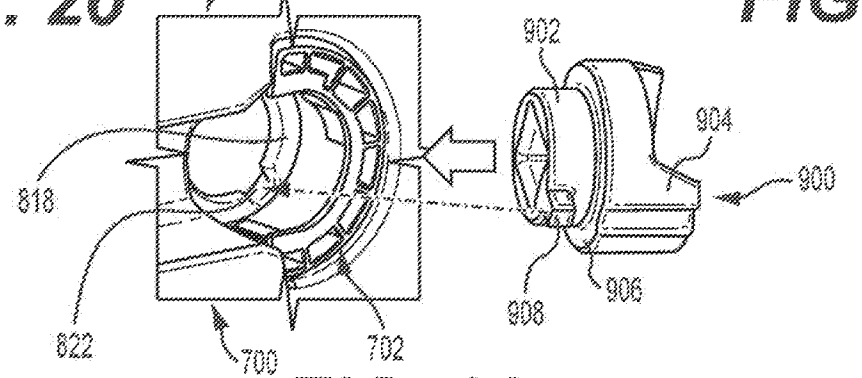
FIG. 22 is an exploded assembly view illustrating the insertion of the retainer into the retainer sleeve of FIG. 21. The hook tab passes through the gap of the ring of the pocket during this step of assembly to yield the wear member assembly of FIG. 20.

During assembly that is illustrated by FIG. 22, the retainer 900 is snapped into the retainer sleeve 702 with the hook tab 908 aligned with the thru-slot 822 of the ring 818 of the wear member 800. Once the hook tab passes axially through the thru-slot, then the retainer 900 may be rotated with the ring 818 of the wear member 800 disposed radially in the passageway 910 as understood taking FIGS. 18 thru 20 together. Now, the retaining mechanism (e.g., the retainer) may be less likely to tip or cock due to the added guidance alluded to earlier herein.

Focusing on FIG. 24, the retainer 900 will now be described in further detail, which may be supplied as a replacement part.

The retainer 900 may comprise a drive portion 902 defining a drive portion outer diameter OD902, and a lug receiving portion 912 defining a lug receiving slot 914 that extends partially through the lug receiving portion 912, forming a first sidewall 916, a second sidewall 918, and a catch surface 920 (see FIG. 20) connecting the first sidewall 916 to the second sidewall 918.

More particularly, a skirt 904 is provided that at least partially defines the first sidewall 916, second sidewall 918, and the catch surface 920. The skirt 904 may define a skirt outer diameter OD904 (see FIG. 24) that is greater than the drive portion outer diameter OD902. This may not be the case in other embodiments of the present disclosure. Also, the hook tab 908 may extend radially from the drive portion 902, and may be spaced away from the skirt 904 a minimum distance 922 (see FIG. 24, e.g., at least 1.0 mm) to form the passageway 910. Put another way, the hook tab 908 may define a hook axial thickness T908 that is greater than or equal to the minimum distance 922. Other configurations and dimensions are possible in other embodiments of the present disclosure.

The drive portion 902 may include a drive portion arcuate surface 924 (e.g., may be conical, cylindrical, etc.) defining an axis of rotation (may be coincident with 704 once assembled as shown in FIG. 20), a radial direction (may be coincident with 706 once assembled as shown in FIG. 20) that is perpendicular to the axis of rotation, and a circumferential direction (may be coincident with 708 once assembled as shown in FIG. 18) about the axis of rotation. Other configurations are possible in other embodiments of the present disclosure.

Figure 24:
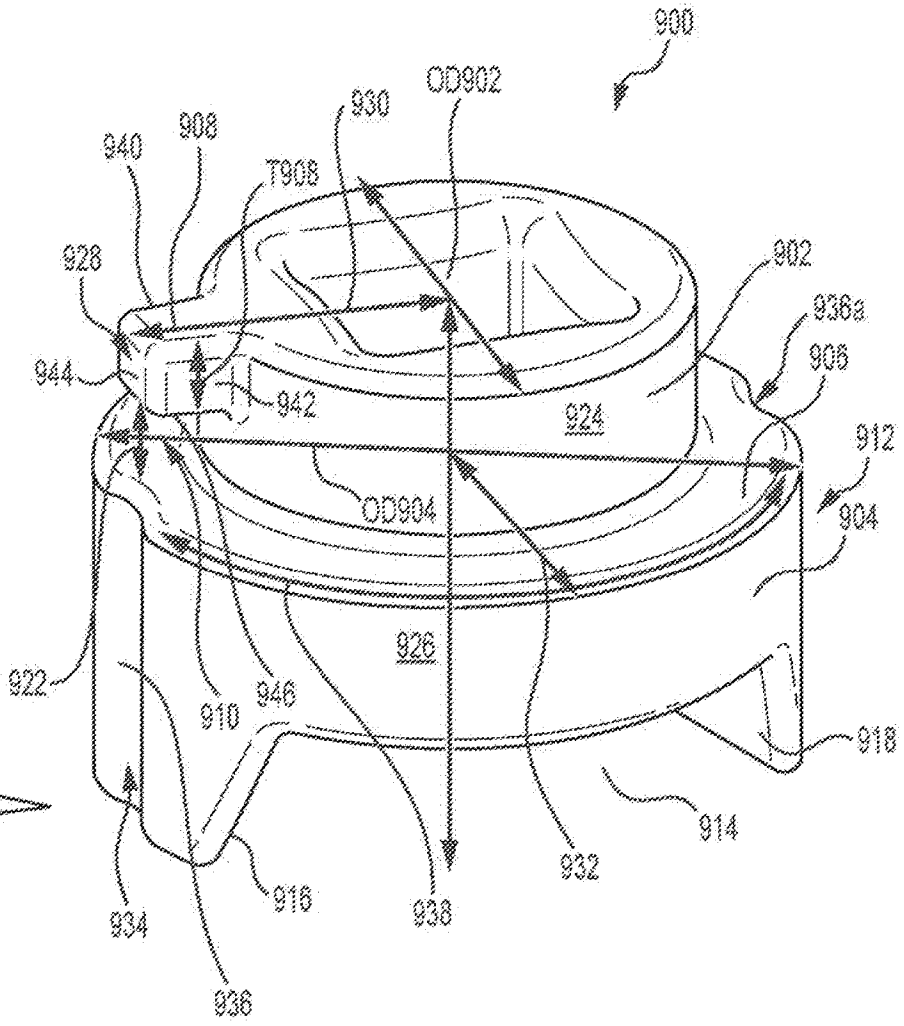
FIG. 24 is a perspective view of the retainer FIGS. 17 thru 20, and 22 shown in isolation.

In FIGS. 20 and 24, the skirt 904 may also have a skirt arcuate surface 926 that is centered about the axis of rotation. In FIG. 24, the hook tab 908 defines a hook radial extremity 928 that is spaced radially away from the axis of rotation a radial dimension 930 that is less than half of the skirt outer diameter OD904 (which is equal to the skirt radial dimension 932).

In FIG. 24, it can be seen that the skirt defines a first detent recess 934 that is disposed axially under the hook tab 908. This may not be the case for other embodiments of the present disclosure. As shown, the first detent recess 934 may take the form of a first groove 936 that extends axially completely through the skirt 904 (but not necessarily so) on the skirt arcuate surface 926. Also, the skirt 904 may defines a second groove **936*a* that extends completely through the skirt 904 on the skirt arcuate surface 926, and that is spaced circumferentially away from the first groove 936 an angular extent 938** ranging from 160.0 degrees to 200.0 degrees in various embodiments of the present disclosure. Again, this may not be the case in other embodiments of the present disclosure.

The hook tab 908 may be complimentarily shaped to the thru-slot of the wear member. So, as shown in FIGS. 19 and 24, the hook tab 908 may include a first straight surface 940 extending from the drive portion arcuate surface 924, a second straight surface 942 extending from the drive portion arcuate surface 924, a third straight surface 944 that is tangential to the circumferential direction, and that connects the first side straight surface 940 to the second straight surface 942, forming the hook radial extremity 928.

As seen in FIG. 24, a flat bottom surface 946 may extend from the drive portion arcuate surface 924, connecting the first straight surface 940, the second straight surface 942, and the third straight surface together 944. This arrangement thus defines the passageway 910 for receiving the ring of the wear member, as well as a polygonal perimeter that matches that of the thru-slot of the ring of the wear member. Other configurations are possible in other embodiments of the present disclosure.

Further details of the wear member 800, which may be provided as a replacement part, will now be discussed starting with FIGS. 17 thru 19, and 23.

Such a wear member 800 may comprise a body including a forward closed portion 802, a rear open portion 804 defining a cavity 806, an exterior surface 808, and an interior surface 810 defining the cavity 806 as previously described herein.

The body of the wear member 800 may also define a retaining mechanism receiving aperture 812 including an interior portion 814 defined by the interior surface 810, an exterior portion 816, defined by the exterior surface 816, and a ring 818 dividing or separating the interior portion 814 from the exterior portion 816.

Figure 23:
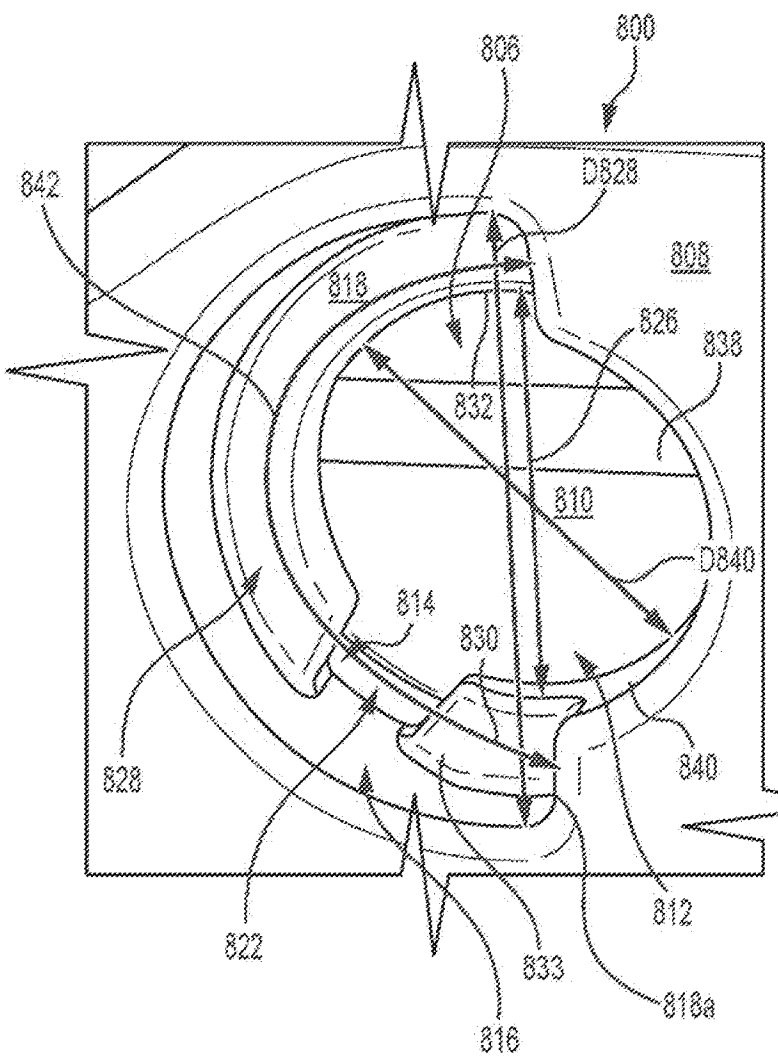
FIG. 23 is an exterior perspective of the wear assembly of FIG. 18 with the retainer sleeve and retainer removed. The ramp of the lower ring portion of the ring of the pocket of the tip is shown clearly.

Focusing on FIG. 23, the exterior portion 816 of the retaining mechanism receiving aperture 812 may include a drive portion receiving aperture 838 (so called since it mates with the drive portion of the retainer) with an arcuate surface 840 (e.g., may be cylindrical, conical, polynomial, etc.) defining a first outer diameter D840. A hook tab receiving slot 828 may define a second outer diameter D828 that is greater than the first outer diameter D840. The ring 818 may extend radially inwardly from the second outer diameter D828 to form the bottom of the hook tab receiving slot 828. A first circumferential stop surface (e.g., see 830) is spaced circumferentially away from a second circumferential stop surface (e.g., see 830) a predetermined angle 842 that ranges from 160.0 degrees to 200.0 degrees in some embodiments of the present disclosure. Other configurations and dimensions are possible in other embodiments of the present disclosure.

As alluded to earlier herein, the ring 818 defines the thru-slot 822 that is in communication with the interior portion 814, and the exterior portion 816 of the retaining mechanism receiving aperture 812.

In addition, the ring 818 may define an inner diameter 826 that is concentric (and may be coextensive as shown) with the first outer diameter D840, and that is less than the second outer diameter D828. The second outer diameter D828 may be concentric with the inner diameter 826, and the thru-slot 822 may be spaced circumferentially away from the first circumferential stop surface (e.g., see 830) with a ring portion 818*a* disposed between the first circumferential stop surface and the thru-slot 822. This may not be the case in other embodiments of the present disclosure. When present, the remainder of the ring 818 may extend circumferentially from the thru-slot 822 to the other stop surface (e.g., see 832).

The previously mentioned ramp 833 on the ring 818 may face axially outwardly toward the exterior surface 816 of the wear member 800. This ramp 833 may extend circumferentially from the thru-slot 822 toward the first circumferential stop surface (e.g., see 830), stopping short thereof in some embodiments of the present disclosure.

Also, the interior portion 814 of the retaining mechanism receiving aperture 812 may include a pair of radially angled surfaces 834, 834*a* that are angled relative to each other, forming an undercut along the axis of rotation 704. Other methods of retention for holding the retaining mechanism in the wear member may be employed in other embodiments of the present disclosure. As seen in FIG. 24, and the lug receiving groove 837 previously mentioned herein, may extend from the interior portion of the retaining mechanism receiving aperture toward the exterior surface of the wear member.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A wear member comprising:

a body including a forward closed portion and a rear open portion defining a cavity;

an exterior surface;

an interior surface defining the cavity; and a retaining mechanism receiving aperture including an interior portion defined by the interior surface, an exterior portion defined by the exterior surface, and a ring dividing the interior portion from the exterior portion; and wherein the exterior portion includes a drive portion receiving aperture with an arcuate surface defining a first outer diameter, a radial direction, an axis of rotation, a circumferential direction, and a hook tab receiving slot that defines a second outer diameter that is greater than the first outer diameter and the ring extends radially inwardly from the second outer diameter, a first circumferential stop surface, and a second circumferential stop surface that is spaced circumferentially away from the first circumferential stop surface a predetermined angle that ranges from 160.0 degrees to 200.0 degrees.

2. The wear member of claim 1, wherein the ring defines a thru-slot that is in communication with the interior portion and the exterior portion of the retaining mechanism receiving aperture.

3. The wear member of claim 2, wherein the ring defines an inner diameter that is concentric with the first outer diameter and that is less than the second outer diameter, the second outer diameter is concentric with the inner diameter, and the thru-slot is spaced circumferentially away from the first circumferential stop surface with a ring portion disposed between the first circumferential stop surface and the thru-slot.

4. The wear member of claim 3, further comprising a ramp on the ring facing toward the exterior surface that extends circumferentially from the thru-slot toward the first circumferential stop surface, the interior portion of the retaining mechanism receiving aperture includes a pair of radially angled surfaces relative to each other, forming an undercut along the axis of rotation, and a lug receiving groove extending from the interior portion of the retaining mechanism receiving aperture to the exterior surface.

5. A wear member assembly comprising:
a wear member having a body including
a forward closed portion and a rear open portion defining a cavity;
an exterior surface;
an interior surface defining the cavity; and
a retaining mechanism receiving aperture including an interior portion defined by the interior surface, an exterior portion defined by the exterior surface, and a ring dividing the interior portion from the exterior portion; and
a retainer sleeve including
a body including
an at least partially annular configuration defining an axis of rotation, a radial direction, and a circumferential direction;
a radially inner annular surface defining a radially inner aperture;
wherein the retainer sleeve is disposed in the interior portion of the retaining mechanism receiving aperture with the ring radially overhanging the body of the retaining sleeve, and extends circumferentially an angle that is greater than 190.0 degrees.

6. The wear member assembly of claim 5, wherein the ring defines a thru-slot that is in communication with the interior portion and the exterior portion of the retaining mechanism receiving aperture, the thru-slot extending radially outwardly short of the radially inner annular surface of the retainer sleeve.

7. The wear member assembly of claim 6, wherein the thru-slot defines at least partially a polygonal perimeter projected onto a plane that is perpendicular to the axis of rotation.

8. The wear member assembly of claim 6, wherein the ring defines an inner diameter that is concentric with the radially inner annular surface of the retainer sleeve, and the thru-slot is in communication with a hook tab receiving slot that is defined circumferentially by a first stop surface and a second stop surface, and the thru-slot is spaced circumferentially away from the first stop surface with a ring portion disposed between the first stop surface and the thru-slot.

9. The wear assembly of claim 8, further comprising a ramp on the ring portion facing toward the exterior surface that extends circumferentially from the thru-slot toward the first stop surface, the interior portion of the retaining mechanism receiving aperture includes a pair of radially angled surfaces forming an obtuse angle relative to each other, forming an undercut along the axis of rotation, and a lug receiving groove extending from the interior portion of the retaining mechanism receiving aperture to the exterior surface.

10. The wear assembly of claim 9, further comprising a retainer with a drive portion extending axially past the ring of the wear member toward the exterior surface, and a skirt interposed axially between the ring of the wear member and a ring of the retainer sleeve with the ring of the wear member configured to axially contact the skirt.

11. The wear assembly of claim 10, wherein the retainer sleeve includes a pair of radially outer surfaces that are complementarily shaped to the radially angled surfaces of the interior portion of the retaining mechanism receiving aperture.

12. The wear assembly of claim 10, wherein the retainer further includes a hook tab that extends radially from the drive portion, forming a passageway extending circumferentially between the hook tab and the skirt, and the ring of the wear member is disposed radially in the passageway.

13. A wear member comprising:
a body including
a forward closed portion and a rear open portion defining a cavity;
an exterior surface;
an interior surface defining the cavity; and
a retaining mechanism receiving aperture including an interior portion defined by the interior surface, an exterior portion defined by the exterior surface, and a ring extending circumferentially about an axis of rotation and dividing the interior portion from the exterior portion;
wherein the ring includes a ramp facing axially outwardly toward the exterior portion,
wherein the exterior portion includes a drive portion receiving aperture with an arcuate surface defining a first outer diameter, a radial direction, the axis of rotation, a circumferential direction, and a hook tab receiving slot that defines a second outer diameter that is greater than the first outer diameter and the ring extends radially inwardly from the second outer diameter, a first circumferential stop surface, and a second circumferential stop surface that is spaced circumferentially away from the first circumferential stop surface.

14. The wear member of claim 13 further including a thru-slot in communication with the hook tab receiving slot.

15. The wear member of claim 14 wherein the thru-slot is defined circumferentially by the first stop surface and the second stop surface, and the thru-slot is spaced circumferentially away from the first stop surface with the ring between the first stop surface and the thru-slot.

16. The wear member of claim 14 wherein the ramp extends circumferentially from the thru-slot forward the first circumferential stop surface, stopping short thereof.

* * * * *